US007834284B2

(12) United States Patent
Iohara

(10) Patent No.: US 7,834,284 B2
(45) Date of Patent: Nov. 16, 2010

(54) KEY UNIT WITH SUPPORT FRAME

(75) Inventor: Yuichi Iohara, Ibaraki (JP)

(73) Assignee: Sunarrow Limited, Tokyo (JP)

( * ) Notice: Subject to any disclaimer, the term of this patent is extended or adjusted under 35 U.S.C. 154(b) by 471 days.

(21) Appl. No.: 11/579,519

(22) PCT Filed: Mar. 16, 2005

(86) PCT No.: PCT/JP2005/004597

§ 371 (c)(1),
(2), (4) Date: Nov. 3, 2006

(87) PCT Pub. No.: WO2005/109460

PCT Pub. Date: Nov. 17, 2005

(65) Prior Publication Data

US 2008/0283375 A1 Nov. 20, 2008

(30) Foreign Application Priority Data

May 7, 2004 (JP) ..... 2004-138602
May 7, 2004 (JP) ..... 2004-138603

(51) Int. Cl.
*H01H 13/70* (2006.01)

(52) U.S. Cl. ..... 200/314; 200/341

(58) Field of Classification Search ..... 200/296, 200/310–314, 341–345, 512–517, 520, 5 A, 200/5 R See application file for complete search history.

(56) References Cited

U.S. PATENT DOCUMENTS 4,732,724 A 3/1988 Sterner
6,166,662 A 12/2000 Chuang (Continued)

FOREIGN PATENT DOCUMENTS

DE 37 16 379 A1 11/1987

(Continued)

OTHER PUBLICATIONS

Notification Concerning Transmittal of International Preliminary Report on Patentability, Chapter I of the Patent Cooperation Treaty, and Written Opinion of the International Searching Authority, dated Nov. 23, 2006, for PCT/JP2005/004597, 7 sheets.

(Continued)

*Primary Examiner*—Edwin A. Leon
*Assistant Examiner*—Marina Fishman
(74) *Attorney, Agent, or Firm*—Holtz, Holtz, Goodman & Chick, PC

(57) ABSTRACT

A key unit includes a reinforcing plate having a support frame for surrounding and supporting key groups arrayed on a key-operating surface of the key unit. The support frame is formed at least by processing the outer edge of the reinforcing plate, and the key unit is installable to a mobile device directly from an outside of a casing of the mobile device through the support frame, for example, by fitting the support frame into an opening provided on the casing of the mobile device into which the key unit should be incorporated. For a decoration to the support frame or an exposed part of the reinforcing plate, there are used printing, painting, or various film-forming methods with a metal or a nonmetal.

6 Claims, 30 Drawing Sheets

U.S. PATENT DOCUMENTS

| | | | | |
|---|---|---|---|---|
| 6,967,292 | B2 * | 11/2005 | Nishimura | 200/5 A |
| 7,038,152 | B2 * | 5/2006 | Watanabe | 200/314 |
| 7,250,937 | B2 * | 7/2007 | Takagi | 345/168 |
| 7,262,379 | B2 * | 8/2007 | Nishimura et al. | 200/314 |
| 7,348,512 | B2 * | 3/2008 | Iohara | 200/341 |
| 2001/0011786 | A1 | 8/2001 | Naritomi | |
| 2003/0109229 | A1 * | 6/2003 | Takagi | 455/90 |
| 2004/0069658 | A1 | 4/2004 | Jeschke | |
| 2004/0200712 | A1 * | 10/2004 | Nishimura et al. | 200/512 |

FOREIGN PATENT DOCUMENTS

| | | | |
|---|---|---|---|
| DE | 298 03 399 | U1 | 6/1998 |
| EP | 1 484 778 | A2 | 12/2004 |
| JP | 63-018727 | A | 1/1988 |
| JP | 1-281797 | A | 11/1989 |
| JP | 4-78630 | U | 7/1992 |
| JP | 7-8927 | U | 2/1995 |
| JP | 7-245039 | A | 9/1995 |
| JP | 9-74439 | A | 3/1997 |
| JP | 2003-178639 | A | 6/2003 |
| JP | 3099977 | U | 12/2003 |

OTHER PUBLICATIONS

Supplementary European Search report dated Dec. 11, 2009, issued in counterpart European Application No. 05720851.4.

Japanese Office Action dated Jun. 8, 2010 and English translation thereof, issued in counterpart Japanese Application No. 2006-512923.

* cited by examiner

KEY UNIT WITH SUPPORT FRAME

This application is a U.S. National Phase Application under 35 USC 371 of International Application PCT/JP2005/004597 filed Mar. 16, 2005.

The present invention relates to a key unit for use in mobile equipment such as portable phones and personal digital assistants (PDA), and further relates to a key unit which comprises a reinforcing plate imparting shape retention-ability to a rubber keypad and which can utilize a part of the reinforcing plate as a design element.

BACKGROUND ART

A key unit is one type of components constituting mobile equipment such as portable phones and personal digital assistants (PDA) or the like, and a multiplicity of keys (push buttons) for switch operation are assembled and arrayed on a surface of a single sheet in one unit. A single key comprises a key top made of a hard resin adhered to the surface of flexible keypads made of various rubbers such as a silicone rubber, a thermoplastic elastomer or the like, and a switch-pressing projection (what is called "pressing element") formed on the back surface of the keypad corresponding to the position of the key top. When a circuit substrate provided with switch elements close contacts with the undersurface of the key unit configured in such manner, key switches are formed at the positions corresponding to each key.

However, the conventional rubber keypads are too soft and lack shape stability, which causes various disadvantages such as incapability of precisely maintaining gaps between key tops and the difficulty of the suitability for automatic assembly. In particular, when a casing is provided with a key frame in order to maintain gaps between the keys, such a new disadvantage occurs that the key tops do not return due to interference with the key frame.

In order to overcome these weak points, there is conceived of the configuration of adding a hard plate material (hereinafter, referred to as "reinforcing plate") to the keypad, and the present applicant has filed a patent application with the title of "hard base key unit" (Patent Reference 1).

In the hard base key unit, the usage of a rubber elastic body is limited only to a key operation part in a keypad, and other parts of the keypad are replaced with a hard resin plate for reinforcement. An aperture is provided at the position corresponding to the key operation part of the hard resin plate which serves as a reinforcing plate, and a rubber elastic body is jointed around the aperture. Further, there are also some alternative conditions where the rubber elastic body covers the overall top surface of the hard resin plate together with the aperture, or the rubber elastic body enfolds the overall hard resin plate including the apertures.

However, the role of the reinforcing plate in Patent Reference 1 only remains imparting rigidity to the keypads and serving also as a light-conducting plate, and no idea is recognized such that the reinforcing plate is positively utilized for a design element of equipment.

Patent Reference 1: Japanese Unexamined Patent Publication No. 2003-178639

Plan view showing a key unit with support frame reinforced with reinforcing plate made of hard resin as Embodiment 1.

FIG. 2

Figure 1:
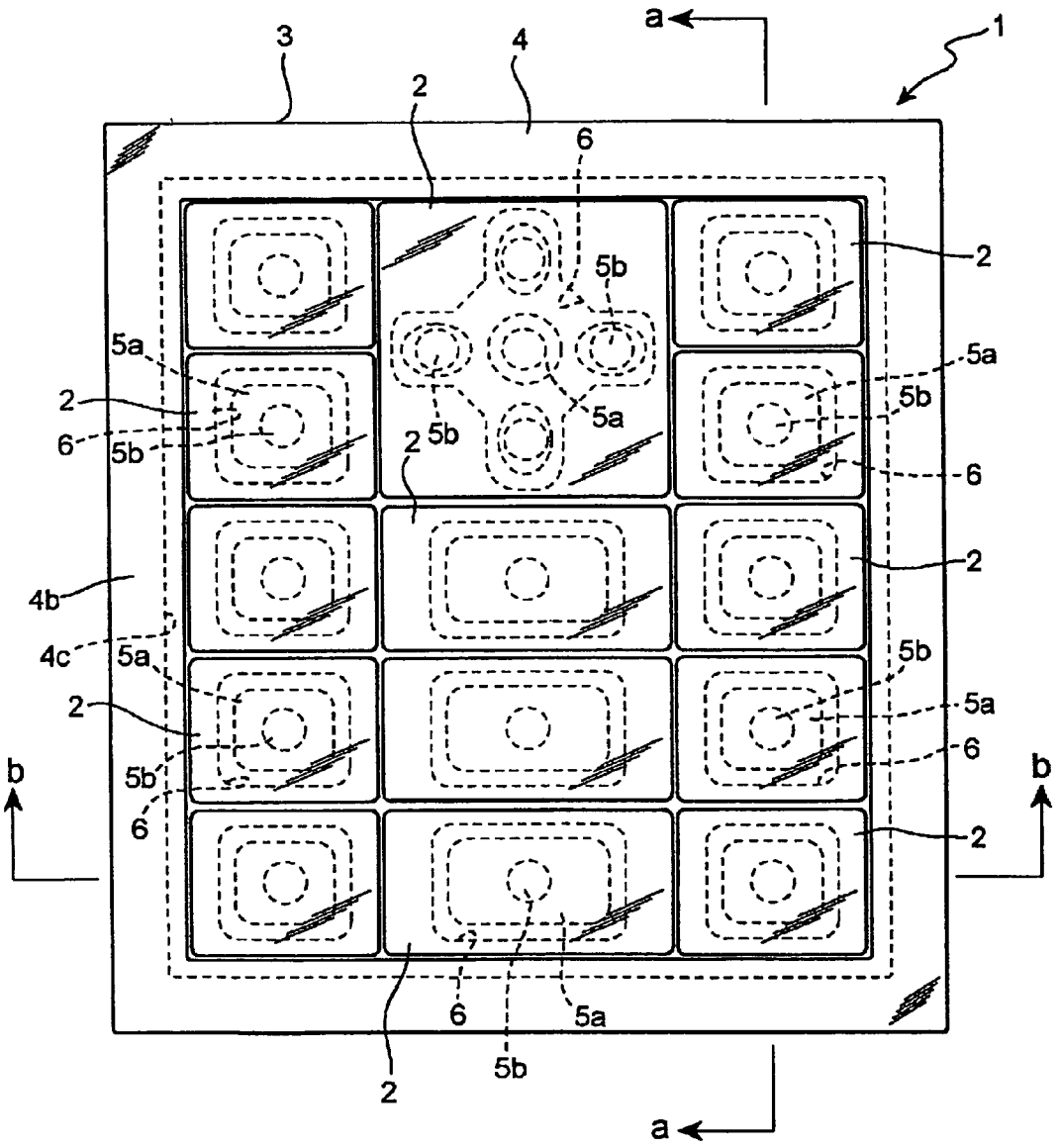
FIG. 1

Plan view showing the key unit with support frame reinforced with reinforcing plate made of hard resin as Embodiment 1 in a condition as seen from the reverse side (back side) of FIG. 1 and in a condition before key tops are attached thereto.

FIG. 3

Plan view showing a keypad in a condition that key tops are detached, in the key unit with support frame reinforced with reinforcing plate made of hard resin as Embodiment 1.

FIG. 4

Plan view of a reinforcing plate for use in the key unit with support frame reinforced with reinforcing plate made of hard resin as Embodiment 1.

FIG. 5

Plan view of a shading sheet for use in the key unit with support frame reinforced with reinforcing plate made of hard resin as Embodiment 1.

FIG. 6

Enlarged sectional view along the line a-a in FIG. 1.

FIG. 7

Enlarged sectional view along the line b-b in FIG. 1.

FIG. 8

Enlarged sectional view showing a decorative layer provided on the top surface of the reinforcing plate, in the key unit with support frame as Embodiment 1.

FIG. 9

Enlarged sectional view showing a decorative layer provided on the bottom surface of the reinforcing plate, in the key unit with support frame as Embodiment 1.

FIG. 10

Plan view showing one example of a portable phone into which the key unit with support frame reinforced with reinforcing plate made of hard resin as Embodiment 1 is incorporated.

FIG. 11

Plan view showing a key unit with support frame reinforced with reinforcing plate made of hard resin as Embodiment 2.

FIG. 12

Figure 11:
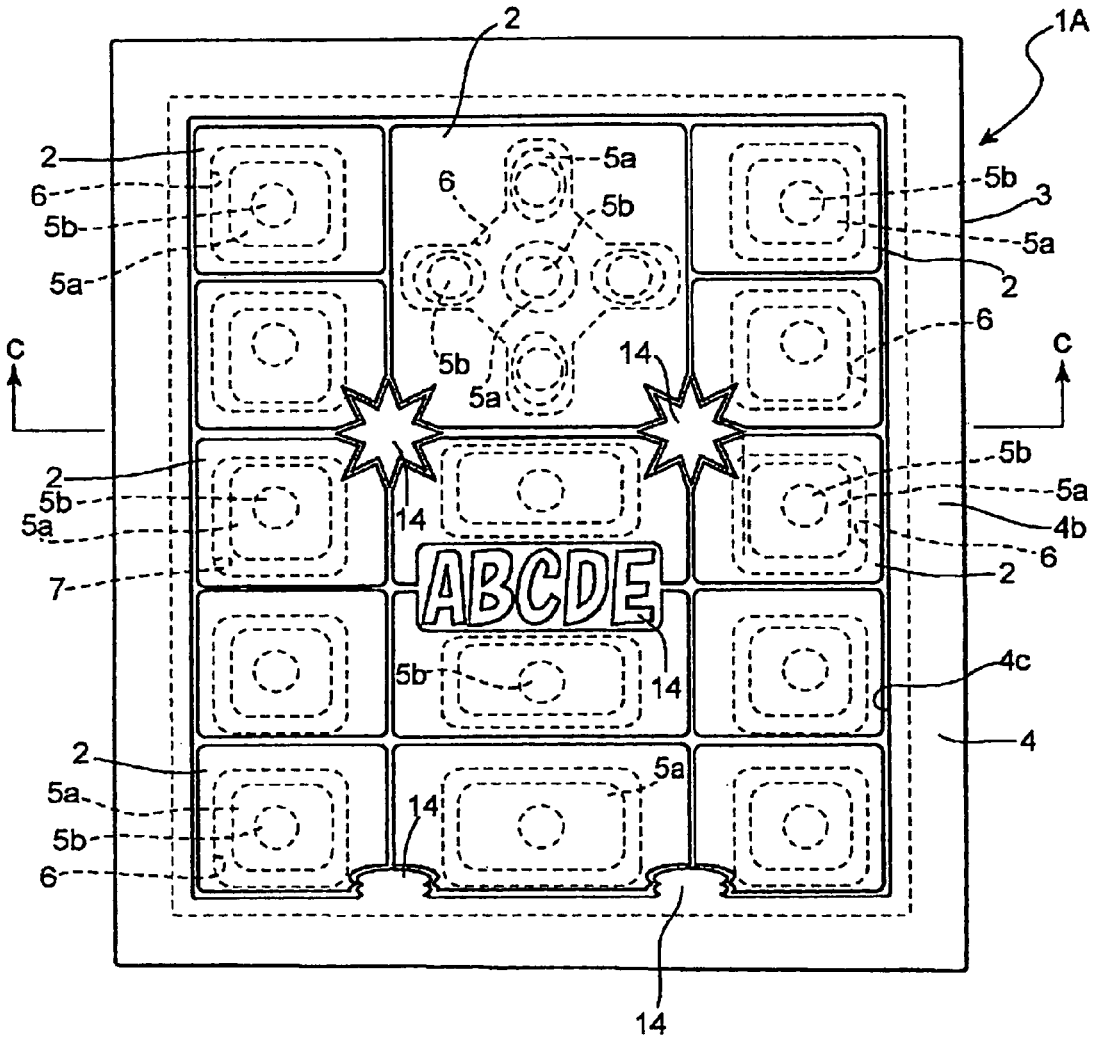

Sectional view along the line c-c in FIG. 11.

FIG. 13

Plan view showing a key unit with support frame reinforced with reinforcing plate made of hard resin as Embodiment 3.

FIG. 14

Figure 13:
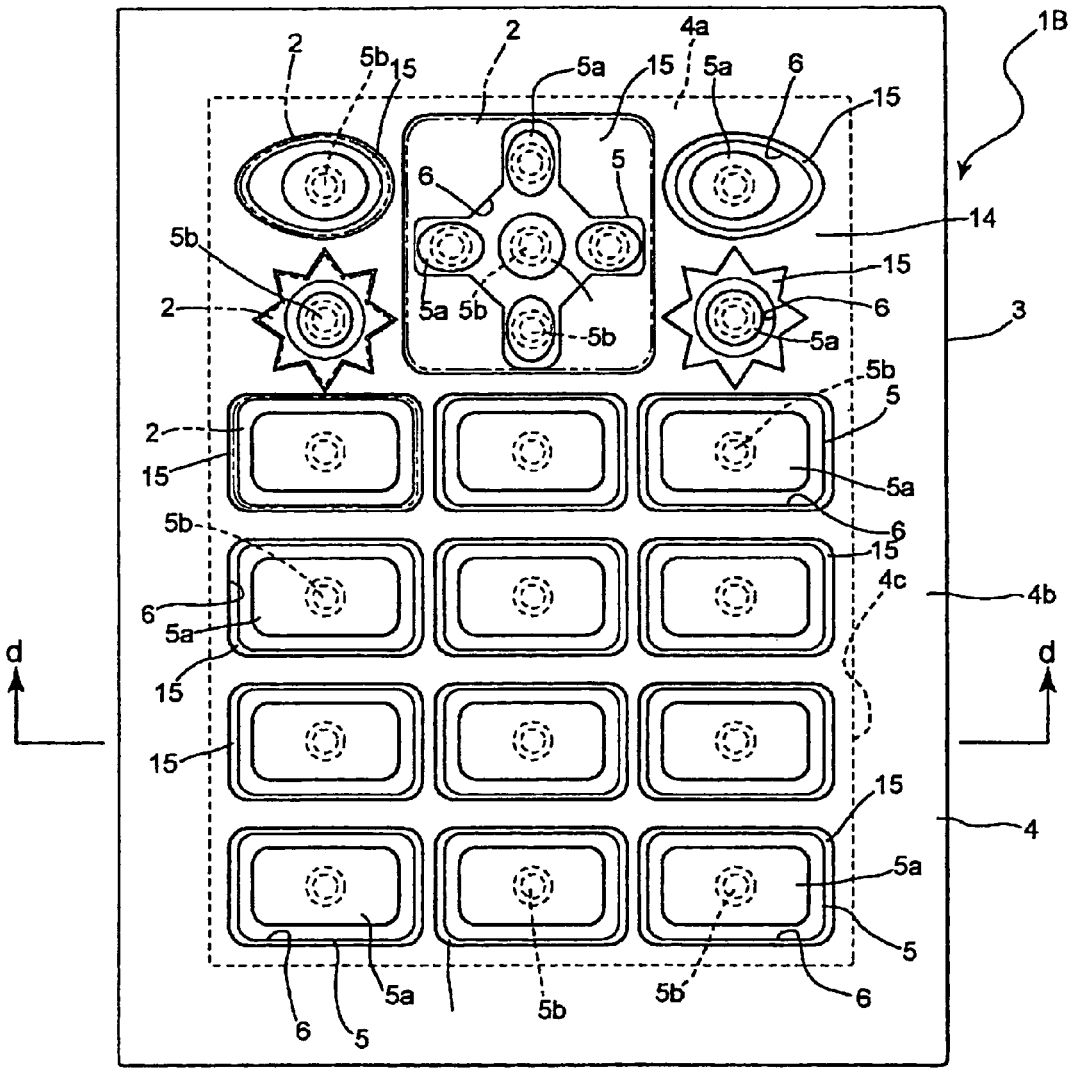

Sectional view along the line d-d in FIG. 13.

FIG. 15

Perspective view showing a modified example in the mode using the key unit with support frame of the present invention, in mobile equipment.

FIG. 16

Figure 15:
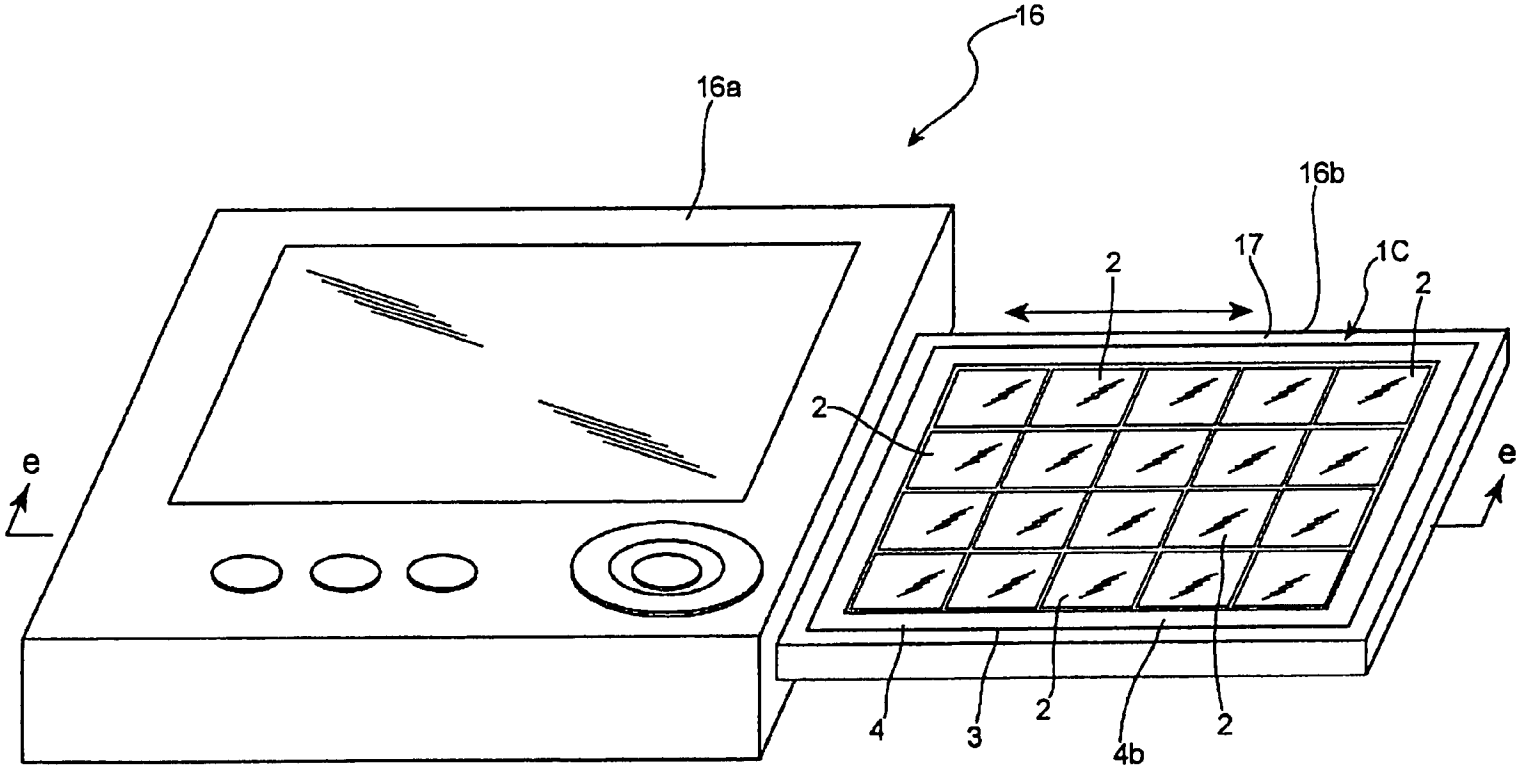

Longitudinal sectional view along the line e-e in a modified example in the mode using the key unit with support frame of the present invention as shown in FIG. 15.

FIG. 17

Plan view showing a key unit with support frame reinforced with metal reinforcing plate as Embodiment 4.

FIG. 18

Plan view showing the key unit with support frame reinforced with metal reinforcing plate as Embodiment 4, as seen from the reverse side (back side) of FIG. 1.

FIG. 19

Plan view showing a keypad in a condition that key tops are detached, in the key unit with support frame reinforced with metal reinforcing plate as Embodiment 4.

FIG. 20

Plan view of a reinforcing plate for use in the key unit with support frame reinforced with metal reinforcing plate as Embodiment 4.

FIG. 21

Figure 17:
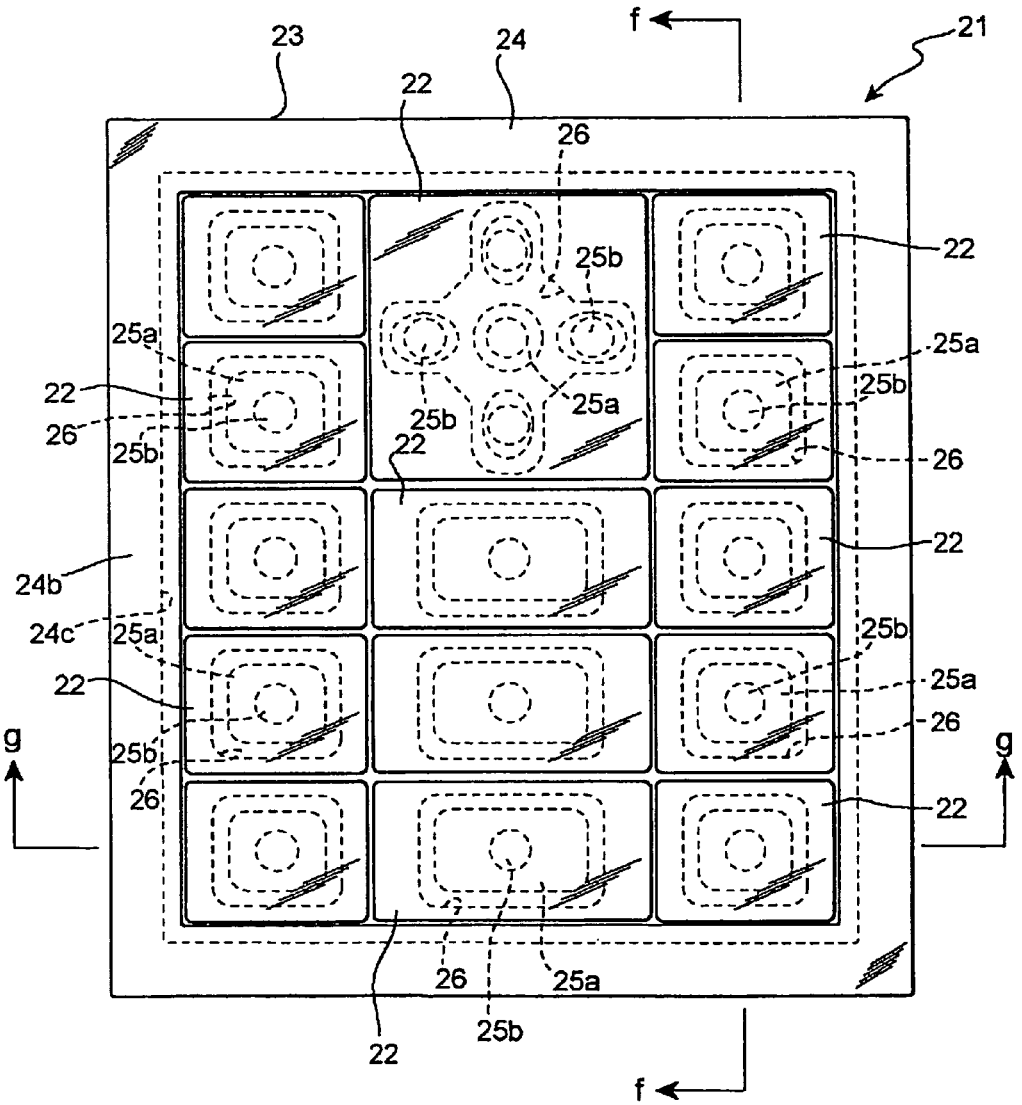

Enlarged sectional view along the line f-f in FIG. 17.

FIG. 22

Enlarged sectional view along the line g-g in FIG. 17.

FIG. 23

Enlarged sectional view showing a decorative layer provided on the top surface of the reinforcing plate, in the key unit with support frame reinforced with metal reinforcing plate as Embodiment 4.

FIG. 24

Plan view showing one example of a portable phone into which the key unit with support frame reinforced with metal reinforcing plate as Embodiment 4 is incorporated.

FIG. 25

Plan view showing a key unit with support frame reinforced with metal reinforcing plate as Embodiment 5.

FIG. 26

Figure 25:
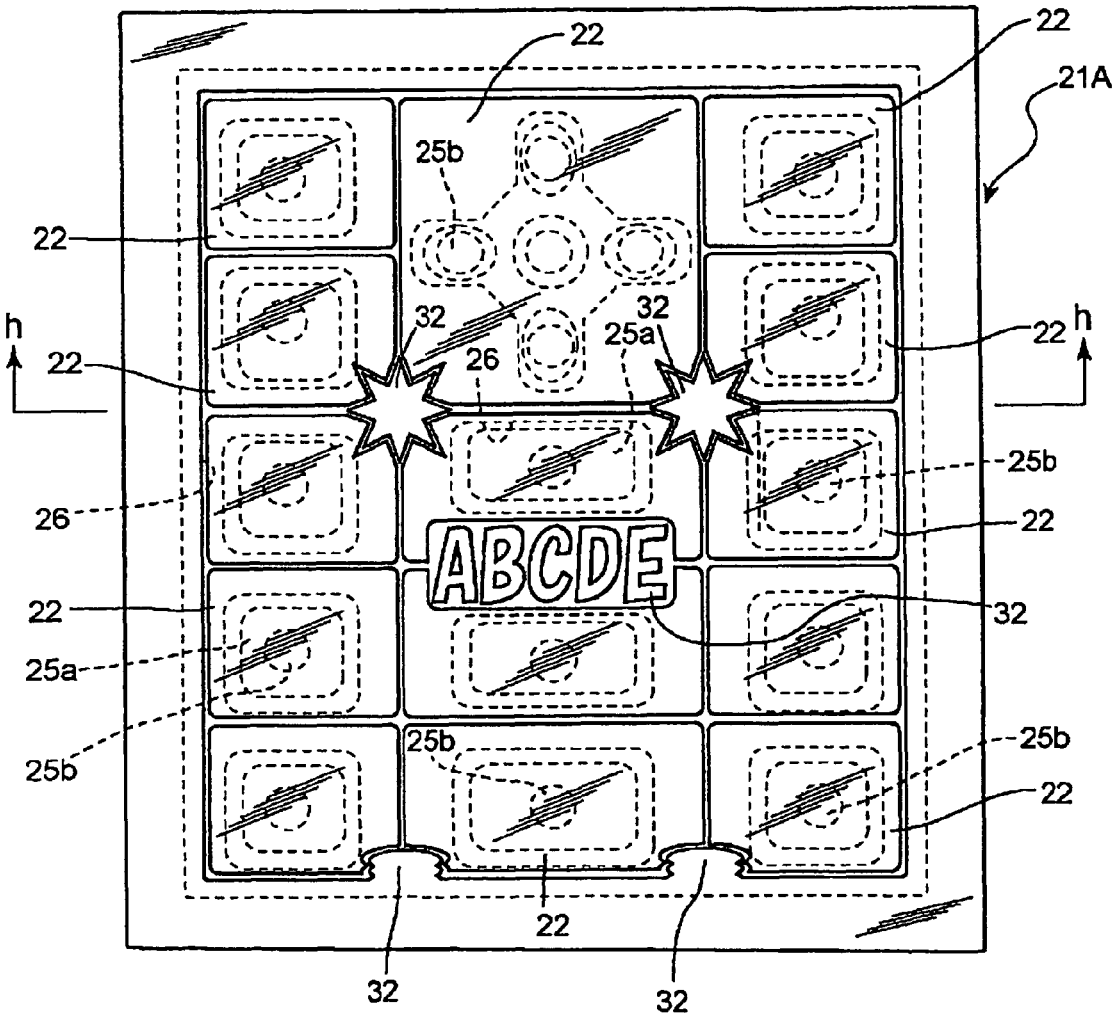

Enlarged sectional view along the line h-h in FIG. 25.

FIG. 27

Plan view showing a key unit with support frame reinforced with metal reinforcing plate as Embodiment 6.

FIG. 28

Figure 27:
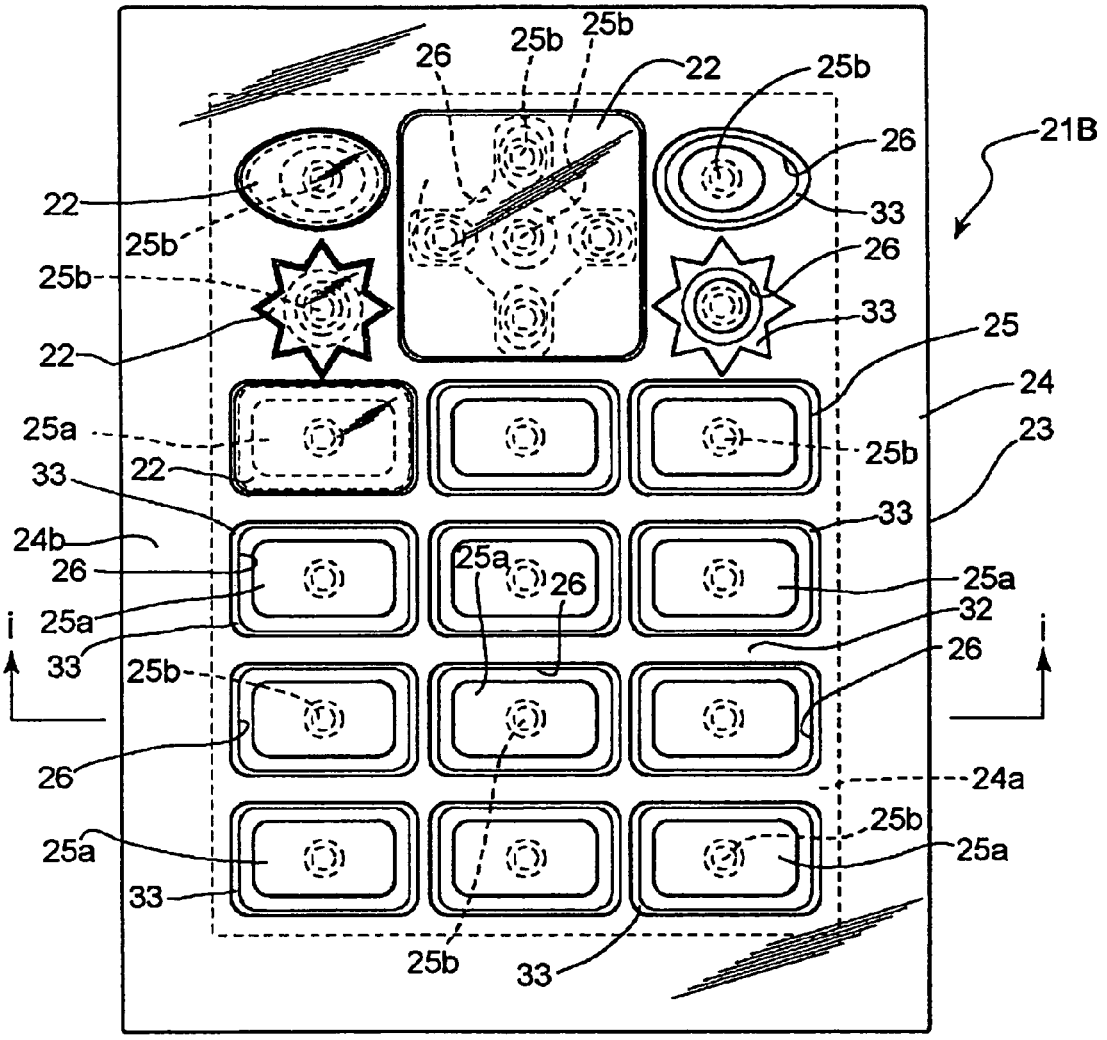
Figure 28:
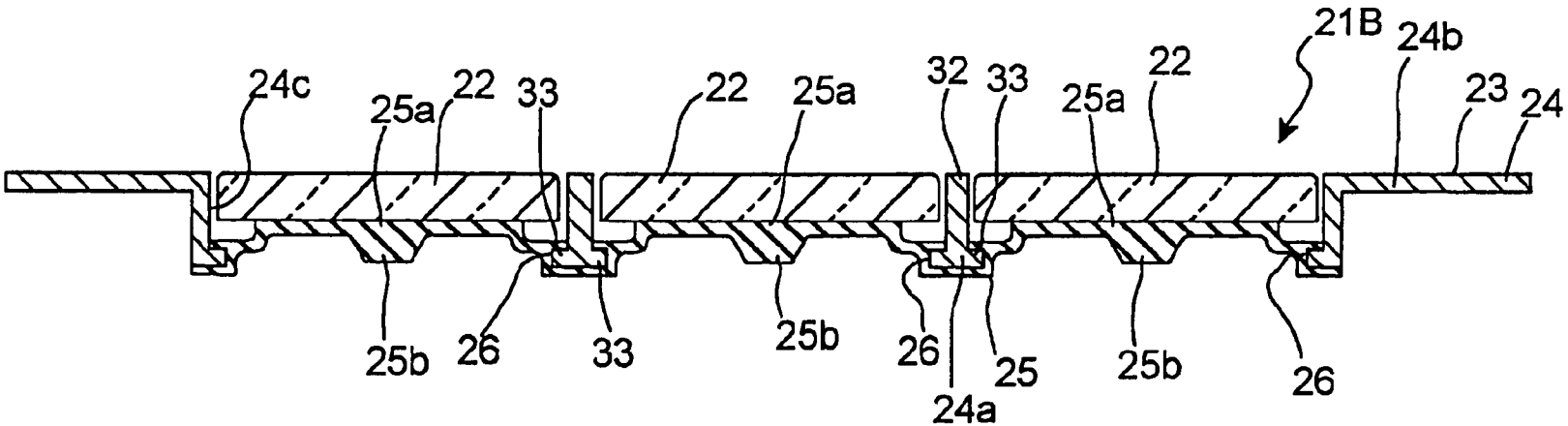

Sectional view along the line i-i in FIG. 27.

FIG. 29

Perspective view showing a modified example in the mode using the key unit with support frame reinforced with metal reinforcing plate, in mobile equipment.

FIG. 30

Figure 29:
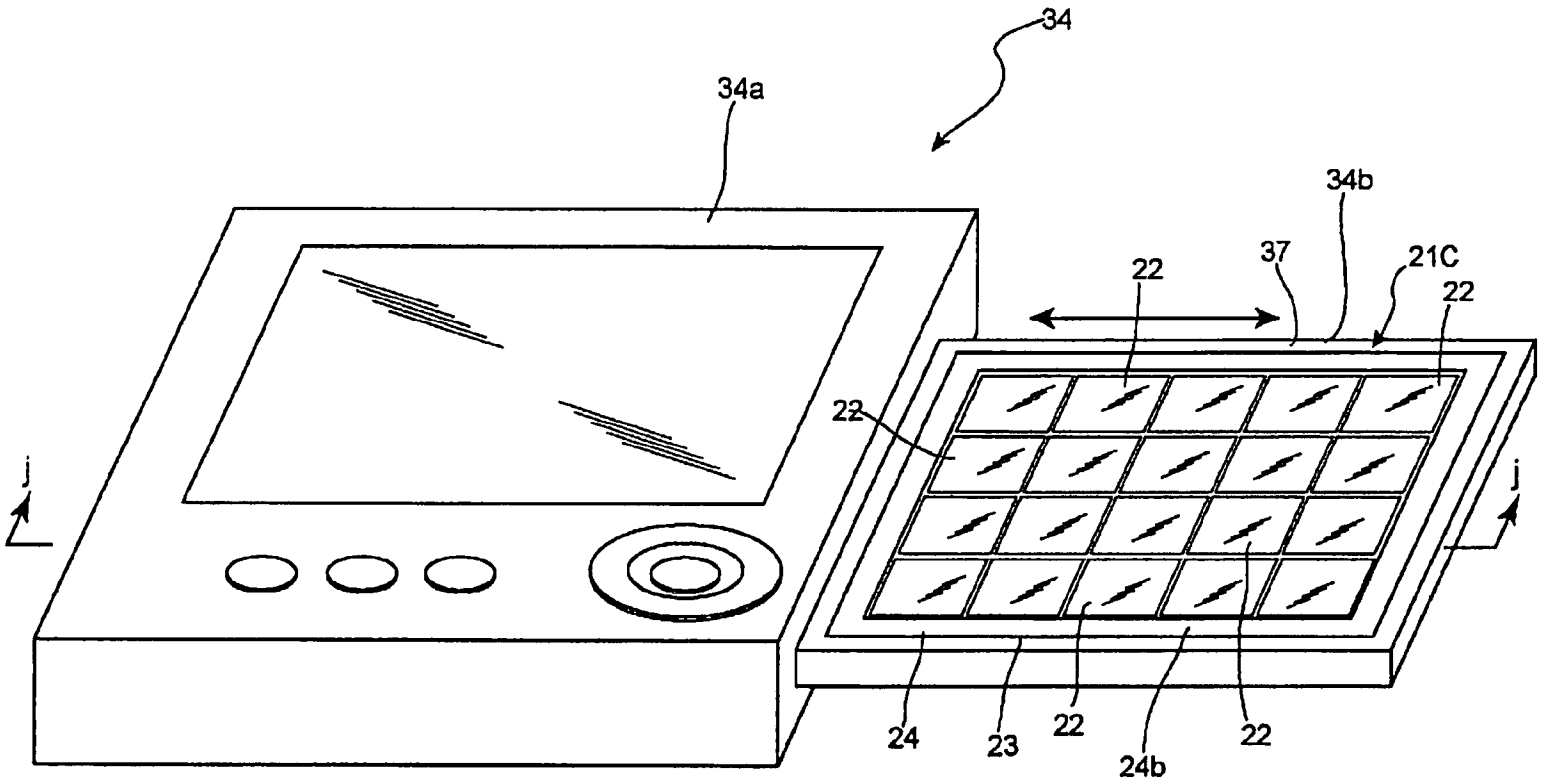

Longitudinal sectional view along the line j-j in the modified example in the mode using the key unit with support frame of the present invention as shown in FIG. 29.

DISCLOSURE OF THE INVENTION

Problems to be Solved by the Invention

The object to be achieved by the invention is to expand the function of a hard resin or a metal reinforcing plate, which is provided for the purpose of imparting shape retention-ability to a rubber keypad in a key unit, so as to find measures for utilizing it even more widely as a functional design element, as well as the purpose of the shape retention-ability of the keypad.

Means for Solving the Problems

As one means for solving the above-mentioned object, it could be conceived that a support frame is formed which surrounds and supports key groups arrayed on a key-operating surface of a key unit in a manner such as a picture frame, by processing the outer edge of a hard resin or a metal reinforcing plate, and the support frame is fitted into an opening provided on a casing or an auxiliary casing of mobile equipment into which the key unit should be incorporated, so that the key unit can be installed directly from the outside of the mobile equipment. At this moment, the auxiliary casing of the mobile equipment indicates a casing which houses, for example, a sliding keyboard (see FIGS. 15 and 16) attached to the mobile equipment main body, other auxiliary keyboards or the like. It should be added that the above-mentioned opening includes "notch" surrounded by adjacent two or three sides.

EFFECT OF THE INVENTION

A conventional key unit has been attached to the inside of a casing as an inseparable component of mobile equipment, and only key tops, as a part of the unit, have been exposed to the outside. On the other hand, key units provided with a support frame (hereinafter, referred to as "key unit with support frame") formed out of a part of a reinforcing plate in accordance with the present invention can be incorporated into mobile equipment directly from the outside without opening (disassembling) the casing, and thus it can be considered as a replaceable module having a certain degree of independence with respect to the mobile equipment main body.

Such module property of the key unit with support frame allows a production system of combining key units with support frame produced in the necessary number by a certain design specification (e.g., language specification for a certain destination) with mobile equipment main bodies mass-produced independently of the design specification immediately before shipment.

Otherwise, it allows a method for use of detaching/replacing a key unit appropriately according to need or preference by preparing a plurality of key units with support frame corresponding to various uses or designs for a single mobile equipment main body.

Further, the key unit with support frame can impart rigidity to keypads and, in addition, can also realize the original effect of a reinforcing plate for the key unit such as the improvement of shape stability, the suitability for automatic assembly, the precision of the key top position or the like.

BEST MODE FOR CARRYING OUT THE INVENTION

In the key unit with support frame of the present invention, a part of the reinforcing plate can also be exposed to the outside, other than the support frame, in order to further utilize the reinforcing plate as a design element. As a location for the exposure, there can be cited a part between each key on the key face or an annular part which encircles a plurality of key clusters. A mode can be considered in which the part of the exposed reinforcing plate (hereinafter, referred to as "exposed part") surrounds each individual key top like a key frame.

The shapes of the outer edge of the support frame and the exposed part are arbitrary. For example, letters, symbols, patterns or the like may be formed thereon.

A part or all of the support frame and the exposed part may be translucent (colored or colorless), so that light may be scattered therethrough. In the case of a hard resin reinforcing plate, a material therefor is preferably a hard resin which has excellent transparency such as PC (polycarbonate resin), PET (polyethylene terephthalate resin), PMMA (polymethylmethacrylate/acrylate resin) or the like. It may also be possible to perform multicolor molding using two or more types of resins including a colored resin.

As a light source for irradiating light, there can be used an EL sheet in which generally-used LED (light-emitting diode) or EL (electroluminescence) elements are formed in a sheet-like manner. When using the EL sheet, the arrangement may be considered in such a manner that the sheet may be attached to the surface of the reinforcing plate, or the sheet may be molded integrally with the reinforcing plate (insert molding) as well as attaching the sheet to the surface of a printed wiring board. In particular, when an EL sheet capable of multicolor luminescence is used, it is possible to illuminate a part or all of the support frame and the exposed part of each key and the reinforcing plate independently for each appropriately divided area, and it is possible to illuminate it into an arbitrary color.

Similar to the decoration to the key top, various methods can be employed to the top surface or the undersurface of the support frame, and the exposed part of the reinforcing plate. For example, there are cited printing (including "hot stamping" which is one type of thermal transfer printing methods), painting, or various film-forming methods (plating, CVD, vapor deposition, sputtering, ion plating, etc.) using a metal or a nonmetal. In addition, in the same manner as each key, it is possible to illuminate the support frame or the exposed part of the reinforcing plate using light from the light source. Further, the surface of the support frame or the exposed part may be coated with a sheet-like material such as a plastic film or the like, so that a single side or both sides of the sheet-like material may be decorated variously as well as direct decoration to a material which constitutes the support frame or the exposed part.

When the reinforcing plate is formed out of a metal material, it is possible to use one or a plurality of metal materials selected from various metals and alloys thereof such as magnesium, aluminum, stainless steel, titanium, copper gold or the like as a material for forming the reinforcing plate in the case of the key unit with metal reinforcing plate.

In order to further utilize the metal reinforcing plate as a design element, a part of the reinforcing plate, other than the support frame, can also be exposed to the outside. As a location for the exposure, there can be cited a part between each key on the key face or an annular part which encircles a plurality of key clusters. A mode can be considered in which the exposed part of the reinforcing plate surrounds each individual key top like a key frame.

Even in a case that the reinforcing plate is made of a metal, the shapes of the outer edge of the support frame and the exposed part are arbitrary. For example, letters, symbols, patterns or the like may be formed thereon. In this case, a metal which can be a material for the reinforcing plate is not necessarily limited to a single kind. For example, if a metal of the kind which even lacks strength for forming the overall reinforcing plate has an advantage in designs such as hue when applied to the exposed part, the reinforcing plate may be formed using a plurality of metal materials.

Further, even in the case of metal reinforcing plate, it is possible to scatter light through the support frame or the exposed part, but the reinforcing plate basically cannot have translucency since the reinforcing plate is made of a metal. However, providing an appropriate aperture or the like at a part of the exposed part allows light to be scattered therethrough. In this case, the aperture provided at the exposed part is preferably filled by a translucent plastic or a rubber elastic body, in view of preventing humidity, dust or the like.

Even in a case that the reinforcing plate is made of a metal, there can be used an EL sheet in which generally-used LED (light-emitting diode) or EL (electroluminescence) elements are formed in a sheet-like manner as a light source for irradiating light. When using the EL sheet, the arrangement may be considered in such a manner that the sheet may be attached to the surface of the reinforcing plate as well as attaching the sheet to the surface of a printed wiring board. In particular, it is possible to illuminate a part of or all the exposed part of each key and the reinforcing plate independently for each appropriately divided area, and it is possible to illuminate it into an arbitrary color by using an EL sheet capable of multicolor luminescence.

Similar to the decoration to the key top, also in the case of metal reinforcing plate, various methods can be employed to the support frame, and the exposed part of the reinforcing plate. For example, there are cited printing (including what is called hot stamping which is one type of thermal transfer printing methods), painting, or various film-forming methods (plating, CVD, vapor deposition, sputtering, ion plating or the like) using a metal or a nonmetal. In addition, in the same manner as each key, it is possible to illuminate the exposed part using light from the light source. Further, the surface of the exposed part may be coated with a sheet-like material such as a plastic film or the like, so that a single side or both sides of the sheet-like material may be decorated variously as well as direct decoration to a material which constitutes the exposed part.

Further, it is possible to utilize the original texture and ground color of the material of the reinforcing plate by polishing the support frame of the reinforcing plate and the surface of the exposed part. However, in this case, it is preferable that an appropriate transparent protective layer should be provided on the surface of the exposed part of the reinforcing plate.

Embodiment 1

FIGS. 1 to 10 show Embodiment 1 with regard to a key unit with support frame formed or reinforced with a reinforcing plate made of a hard resin (hereinafter, refereed simply as "key unit"). The present Embodiment sets forth that a support frame was formed which surrounds key clusters (key groups) constituting three columns as a whole to support the overall key unit in a manner such as a picture frame by processing the outer edge of the reinforcing plate so as to extend it in the circumferential direction.

Figure 2:
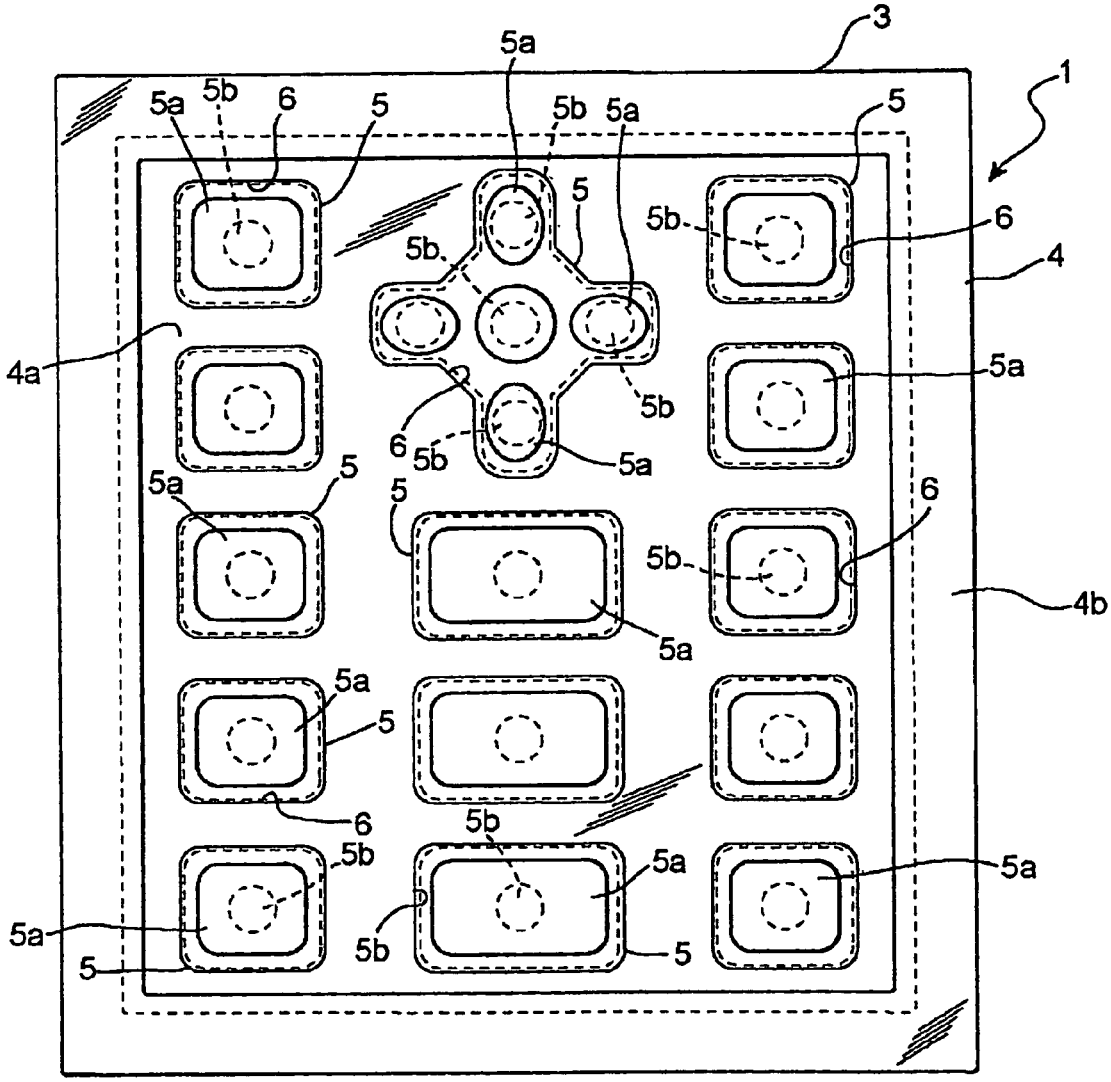
Figure 3:
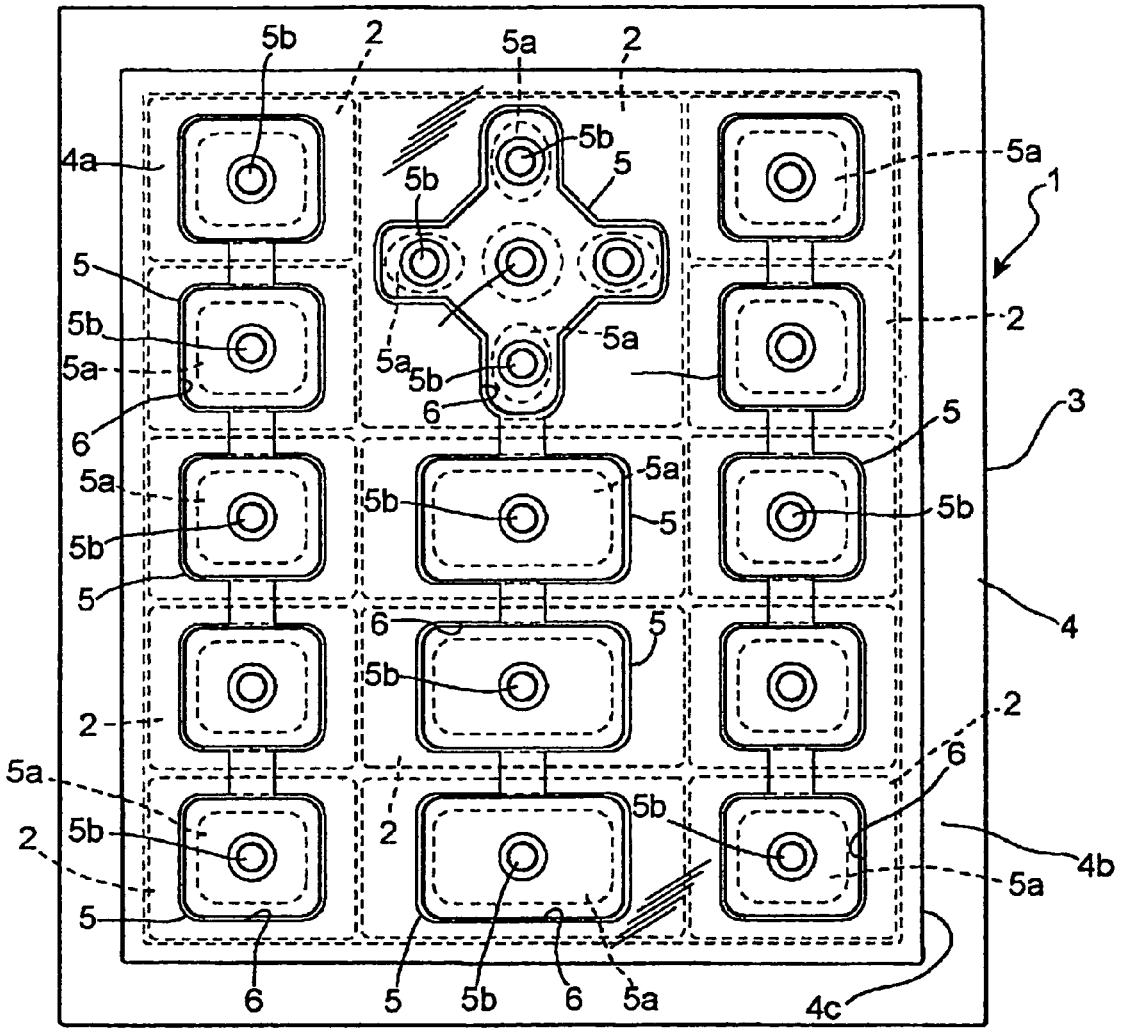
Figure 4:
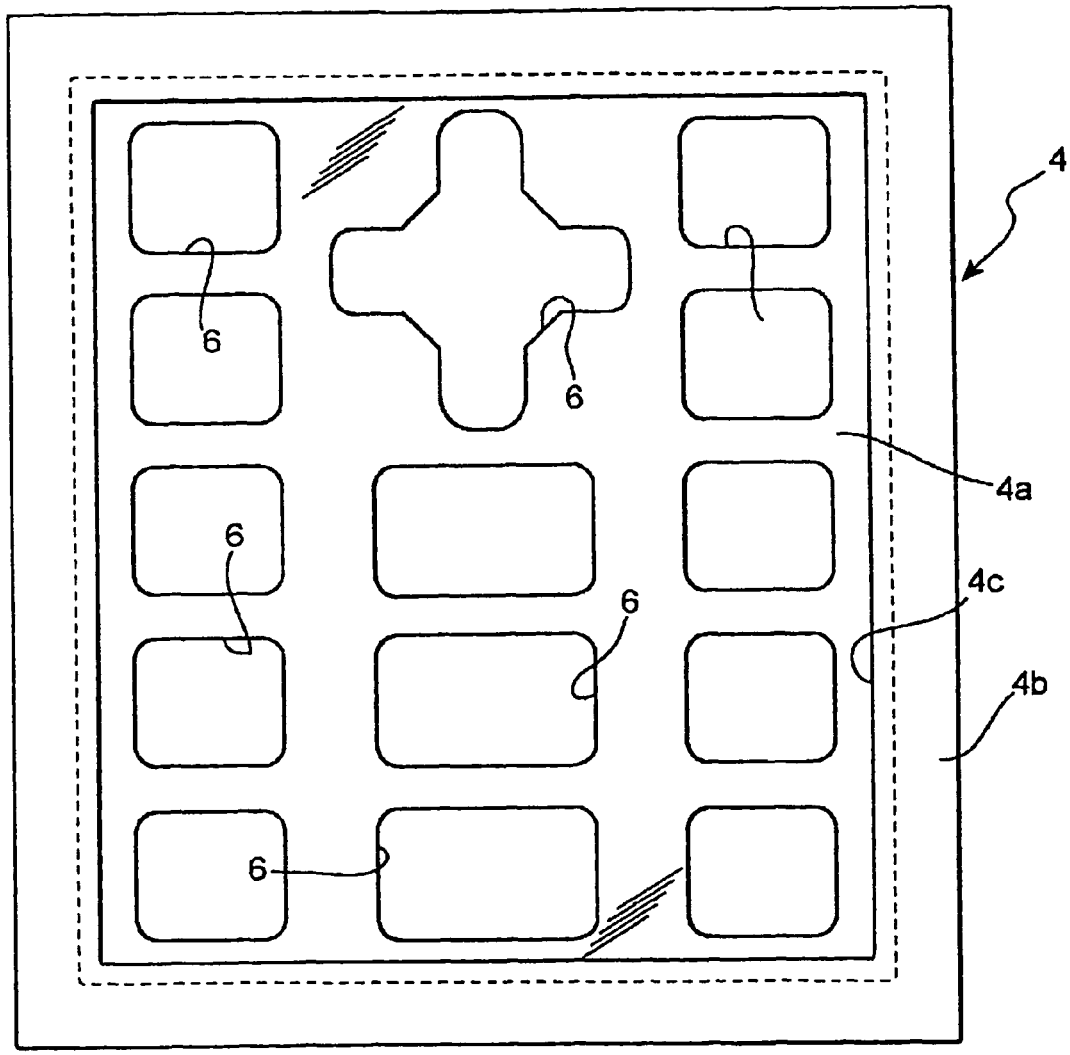

As shown in FIGS. 1 to 3, key unit 1 has key tops 2, 2, . . . , which are formed in desired shapes, and a keypad 3. The keypad 3 comprises a reinforcing plate 4 shaped like a plate with its central portion formed in a concave shape with respect to its circumferential portion, and a pad member 5 constituting a key operation part. The key top 2 and the reinforcing plate 4 are formed of a hard resin which has excellent translucency such as PC, PET or PMMA. The pad member 5 is formed in such a manner as to have a film structure of translucent rubber elastic bodies such as a silicone rubber, a thermoplastic elastomer or the like. The keypad 3 is formed, for example, by means of insert molding applied to a molded reinforcing plate 4 which has already been formed when the pad member 5 is molded. It should be added that for the key unit 1, what is called narrow pitch keys are employed in which a gap between each key top 2 is 0.3 mm or less (preferably about 0.1 mm).

Figure 6:
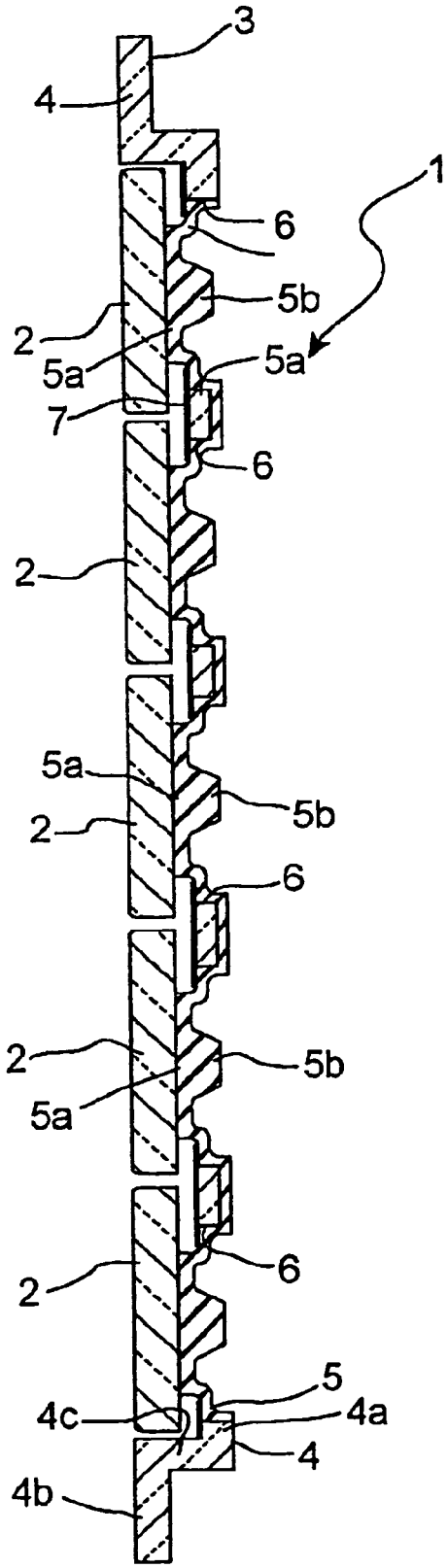

The above-mentioned reinforcing plate 4 comprises a base 4*a* in which a multiplicity of apertures 6 (see FIG. 4) in various shapes are formed and which constitutes the bottom portion of the central concave portion of the reinforcing plate 4, and a support frame 4*b* which extends in the circumferential direction so as to surround the perimeter of the base 4*a* and is positioned at higher level than the base 4*a* in the vertical direction. The base 4*a* and the support frame 4*b* are coupled by a step 4*c* extending in the vertical direction (see FIG. 6). Thus, as shown in FIGS. 6 and 7, it can be said that the reinforcing plate 4 has the approximate shape of a vessel in which the support frame 4*b* is protruded upward with respect to the base 4*a* in its sectional shape.

Further, the apertures 6 of the reinforcing plate 4 are sealed, respectively, by the pad members 5. The end of each pad member 5, as shown in FIGS. 6 to 8, is fixed to the inner wall of an opening of each aperture 6 of the reinforcing plate 4; and forms the apex rising in a skirt-like manner from somewhat inner position of the opening edge of the aperture 6, with the apex constituting a key-fixing part 5*a* which the key top 2 is placed on and fixed to. The key tops 2 are adhered and fixed, respectively, to the top surface of each key-fixing part 5*a* using an adhesive or the like, and switch-pressing projections (pressing elements) 5*b* are formed integrally on a surface (undersurface) opposite to the above-mentioned key-fixing part 5*a*.

Figure 5:
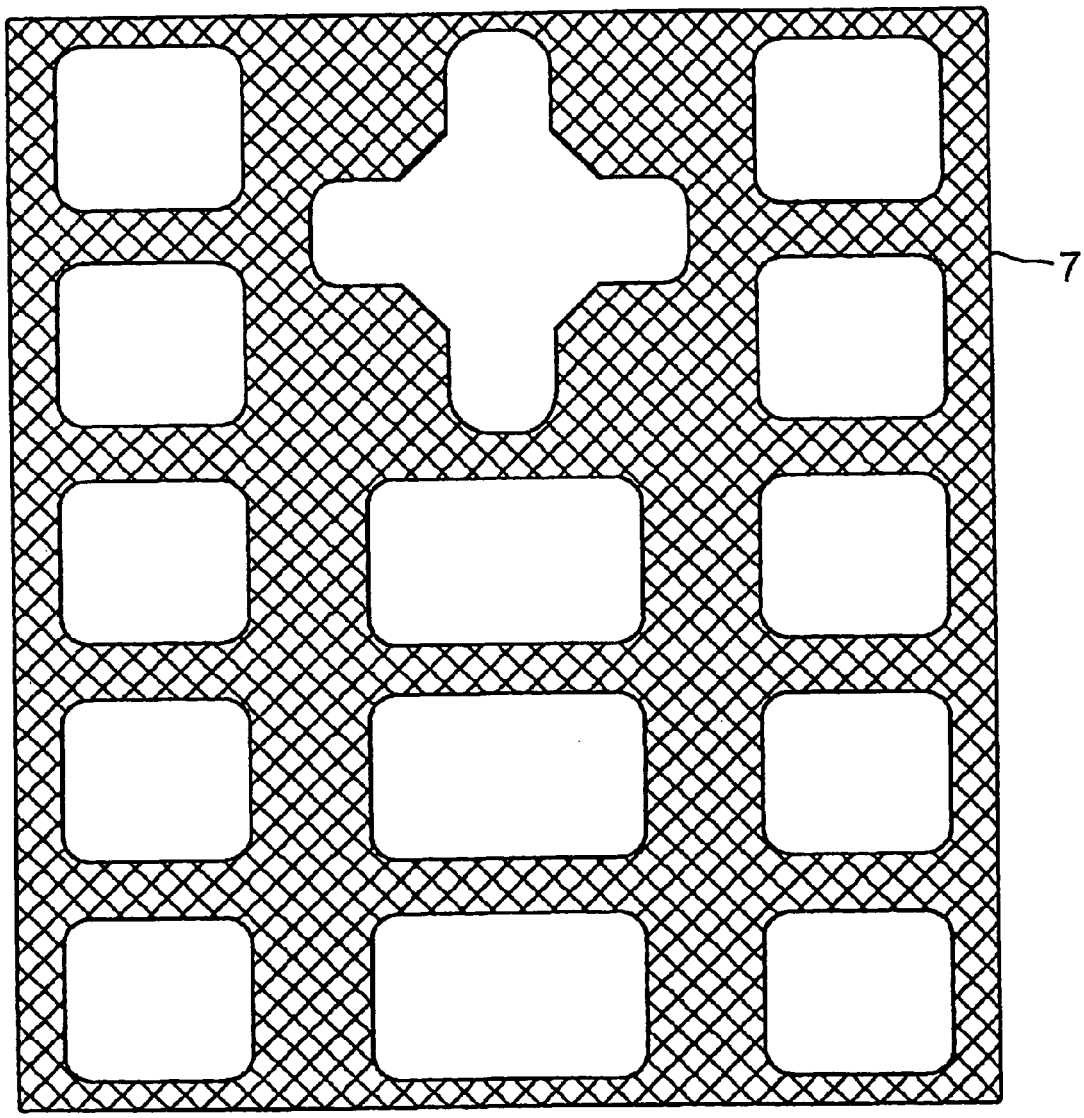

Further, a shading sheet 7 shown in FIG. 5 is laid on the base 4*a* of the reinforcing plate 4 molded integrally with the pad member 5 in such a manner as to cover the surface of other parts except each key-fixing part 5*a* of the pad member 5. While the shading sheet 7 does not constitute an essential requirement for the configuration of the unit 1 of the present invention, it is preferable to use it during illumination since it prevents the leakage of light from the space between the keys and from the space between the key and the support frame 4*b*, so as to improve the appearance of the overall key unit 1.

Figure 7:
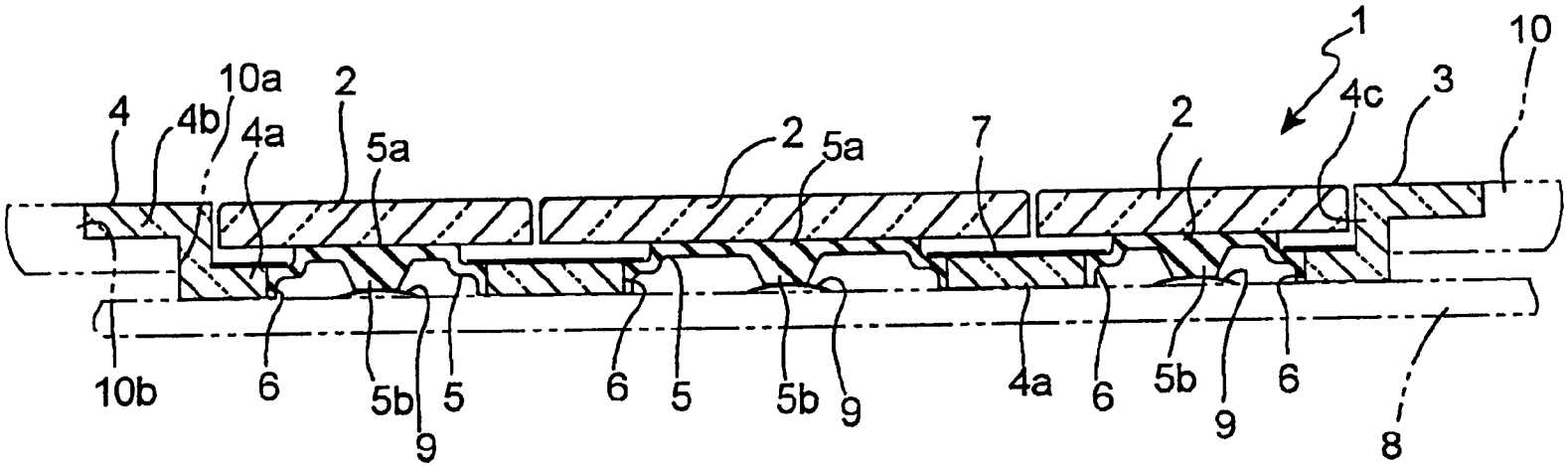
Figure 8:
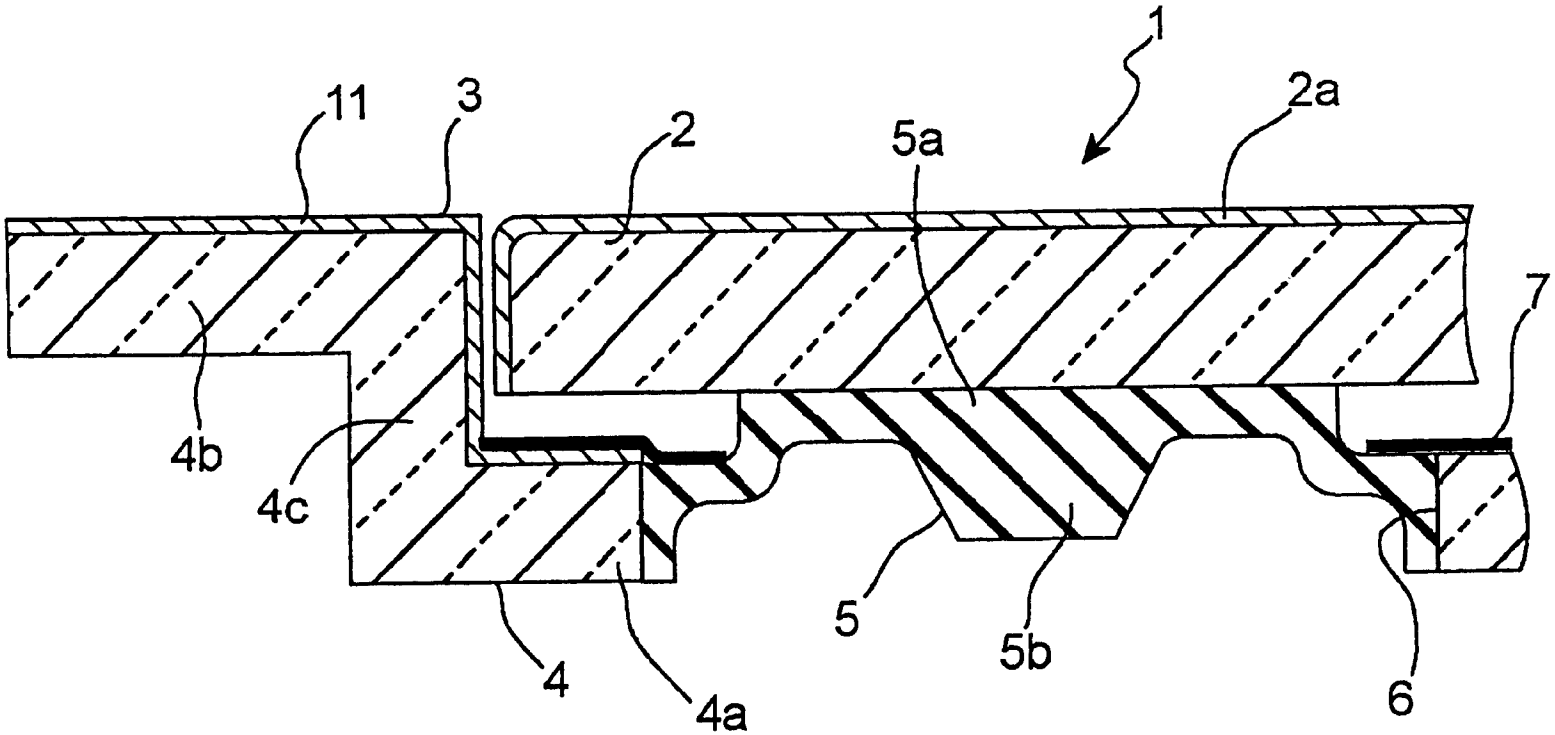

Moreover, in FIG. 7, item indicated by reference number 8 is a printed wiring board on which a multiplicity of switch elements (such as metal dome switches, or contacts not shown or the like) 9 or the like are provided, and item indicated by 10 is a part of a casing for mobile equipment such as portable phones. It should be added that, in the present embodiment, the above-mentioned key-fixing part 5*a* is configured to be projected toward one side (upward), but it is not necessarily required to have such structure. It is possible to form the part 5*a* in an appropriate shape by, for example, configuring it to be positioned at the same level as the surface of the reinforcing plate 4. In a word, it may be sufficient if the switch element 9 is ensured to operate by the pressing element 5*b* when pressing the key top 2.

Decorations including letters, symbols or the like. which represent the function of each corresponding key are applied to the top surface or the undersurface (the surface which is attached and fixed to the pad member 5) of the key top 2 by means of the above-mentioned various decoration methods. In addition, similar decoration is also applied to the top surface or the undersurface of the support frame 4*b* of the reinforcing plate 4.

Figure 9:
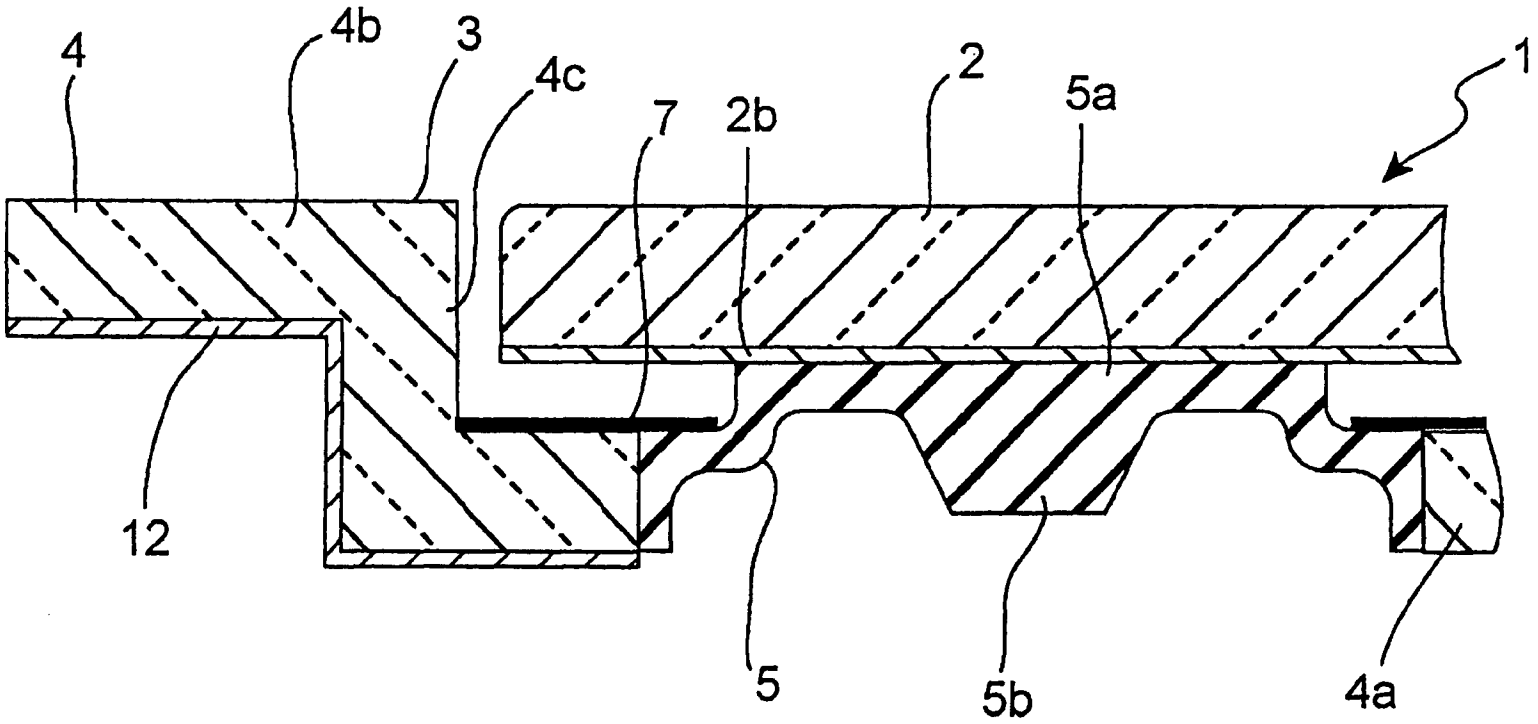

That is, as shown in FIG. 8, a decorative layer 11 is provided by arbitrary means on the top surface of the circumferential portion including the support frame 4*b* of the reinforcing plate 4. Further, in an example shown in FIG. 9, a decorative layer 12 is formed at the circumferential portion including the support frame 4*b* on the undersurface of the reinforcing plate 4. The decorative layers 11 and 12 are generally constituted a plurality of layers peculiar to various decoration methods. The above plurality of layers mean, for example, a character layer which forms characters such as letters or symbols in a positive manner or a negative manner, an overcoat layer which imparts abrasion resistance, a coloring layer which colors letters or symbols, a foundation layer, or the like, when decorating the surface by means of printing or painting. It should be added that items indicated by 2*a* in FIGS. 8 and 2*b* in FIG. 9 are, respectively, appropriate decorative layers provided on the surface and the back surface of the key top 2.

The decorative layers 11, 12 allows the key unit 1 to have decorative effect by coloring the support frame 4*b* of the reinforcing plate 4 which constitutes the circumferential portion of the key unit 1 or by forming patterns, pictures or the like thereon, and to have a further designed feature in addition to the decorative effect of the key top 2. Furthermore, positive or negative arbitrary letters, symbols or the like can also be formed on the support frame 4*b* in the same manner as the key.

Figure 10:
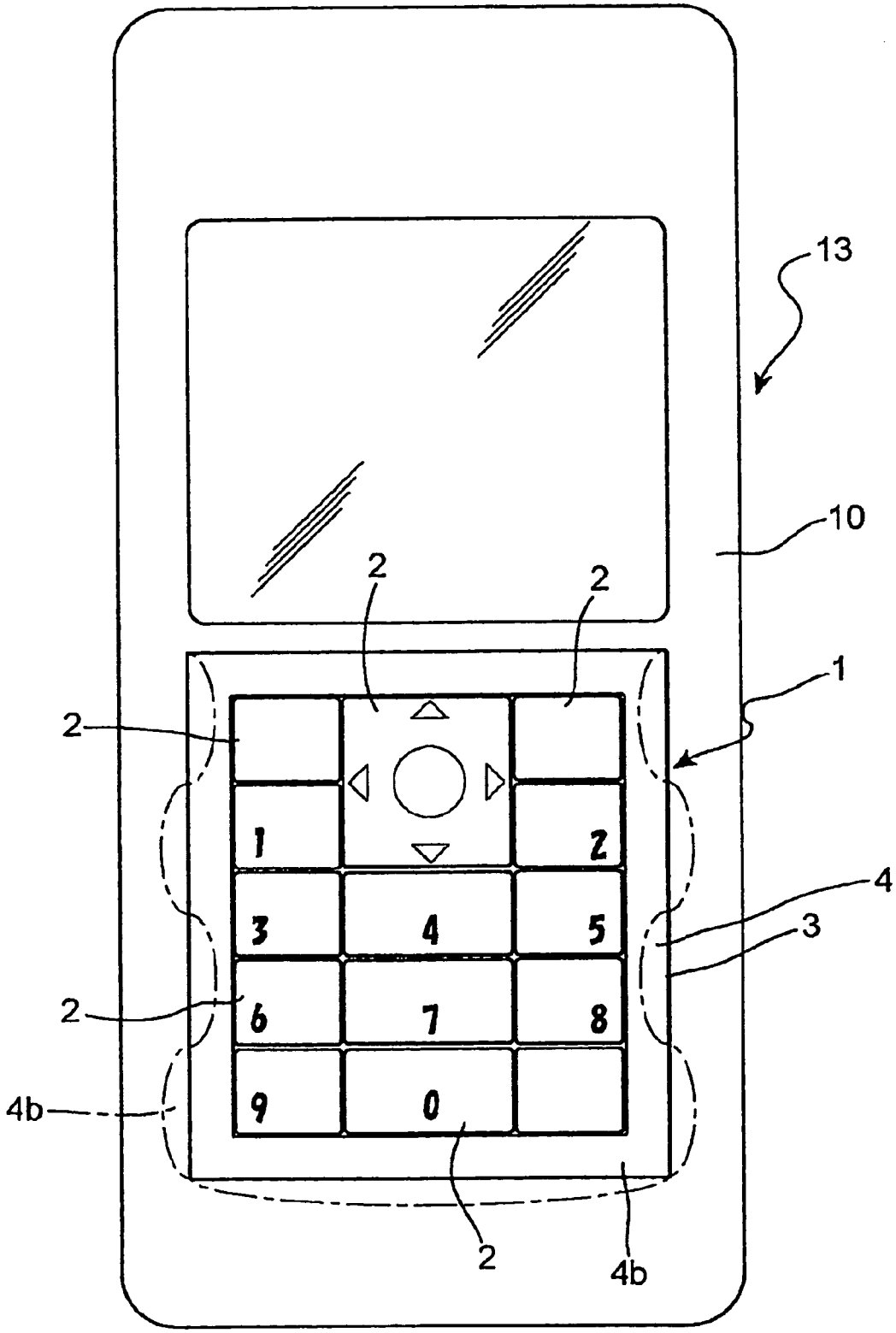

FIG. 10 shows an example in which the key unit 1 is incorporated into a portable phone 13. That is, the key unit 1 is, for example, fixed by fitting the support frame 4*b* of the reinforcing plate 4 into a receiving portion (an opening 10*a*, a step 10*b* or the like provided on a casing 10) provided on the casing 10 of the portable phone 13, as shown in FIG. 7. Further, the illustrated key unit 1 has an outline of approximately rectangular, but the outline shape of the key unit 1 is not limited to a specific one. In addition to decorative effect applied to the support frame 4*b*, it is also possible to allow to have a designed feature by forming the circumferential shape and the entire portion of the support frame 4*b* into various shapes, for example, by using a wave-like curve for the circumferential shape of the support frame of the reinforcing plate 4 as shown by an alternate short and long dash line in the drawing.

The portable phone 13 can achieve various and novel designs which differ from conventional ones by means of the decoration and shape of the support frame 4*b* which surrounds the perimeter of the key groups and constitutes a part of the reinforcing plate 4. Further, the key unit 1 also allows a method for use of detaching/replacing the key unit appropriately according to need or preference, with preparing a plurality of key units with support frames which correspond to various uses or designs for the main body of a single portable phone 13, by forming on the casing 10 the support frame 4*b* and the receiving portion (opening or notch) capable of detaching it.

Embodiment 2

Figure 12:
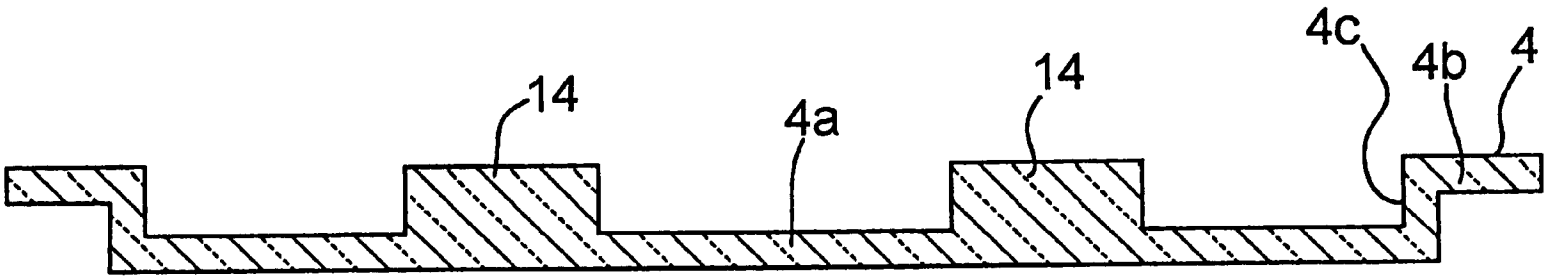

FIGS. 11 and 12 show Embodiment 2 which is another embodiment of the key unit with support frame of the present invention. The key unit 1A in Embodiment 2 has a structure in which, as shown in FIG. 11, a part of the reinforcing plate 4 is exposed to the outside as exposed parts 14 from the space between the keys. The only difference from the key unit 1 in the above-mentioned Embodiment 1 is whether the exposed parts 14 are present or not. Accordingly, for the parts which have the configuration similar to the above-mentioned Embodiment, an explanation is omitted by using the same symbol as the one used in the above-mentioned Embodiment.

That is, the key unit 1A is an example in which, as shown in FIGS. 11 and 12, five locations between the keys of the reinforcing plate 4 are exposed from the space between the key tops 2, 2, . . . as the exposed parts 14, so that each exposed part 14 is formed into an appropriate shape such as a star shape or a dumpling shape, or into an arbitrary letter string of "ABCDE."

Thus, in the key unit 1A, it allows to bring a more novel effect to the key unit 1A and the equipment using it in the aspect of design by means of various decorations and shapes applied to the exposed part 14 as well as a decoration to the support frame 4*a* by providing the exposed part 14 of which number and shape can be freely set.

Embodiment 3

Figure 14:
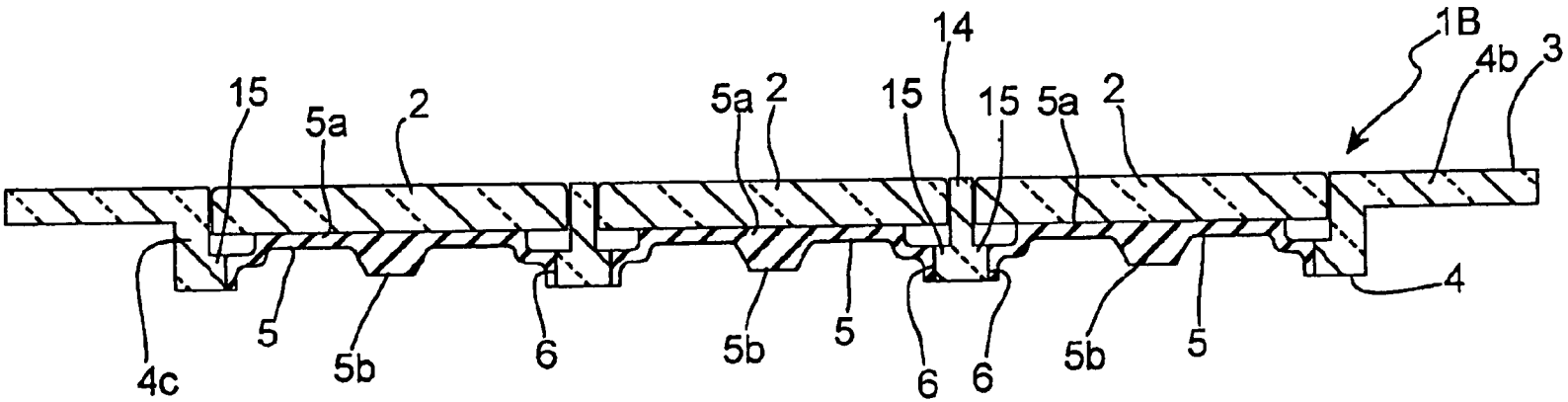

FIGS. 13 and 14 show key unit 1B of Embodiment 3, which is another embodiment, of the key unit with support frame of the present invention. The key unit 1B in the present Embodiment differs from the above-mentioned two Embodiments only in a part of the shape of the reinforcing plate 4, and is an example in which the exposed part 14 is exposed from the space between all of each key tops 2, i.e., in the key unit 1B, the exposed parts 14, which are a plurality of divided sections, are molded integrally so as to surround the perimeter of all the key tops 2,2 . . . . Accordingly, for the parts of the key unit 1B which have the configuration similar to the above-mentioned key units 1 and 1A, an explanation is omitted by using the same symbol as the one used in the above-mentioned key units 1 and 1A.

The reinforcing plate 4 of the key unit 1B, as shown in FIG. 14, has a structure in which the apertures 6 in which the pad member 5 is arranged and other parts except one part of the perimeter of the opening edge of the aperture 6 are protruded to one side (upward) as the exposed part 14. The aperture 6 and a part 15 on which the key tops 2 of the reinforcing plate 4 constituted by a part of the perimeter of its opening edge is placed are relatively concave.

Thus, the key unit 1B, being different from the conventional one which has a key frame, can bring a novel effect to mobile equipment such as portable phones in the aspect of design, by means of various decorations and illuminations which are applied to the exposed part 14 of the reinforcing plate 4, which is a part equivalent to the key frame in addition to the support frame 4*b* of the reinforcing plate 4.

Figure 16:
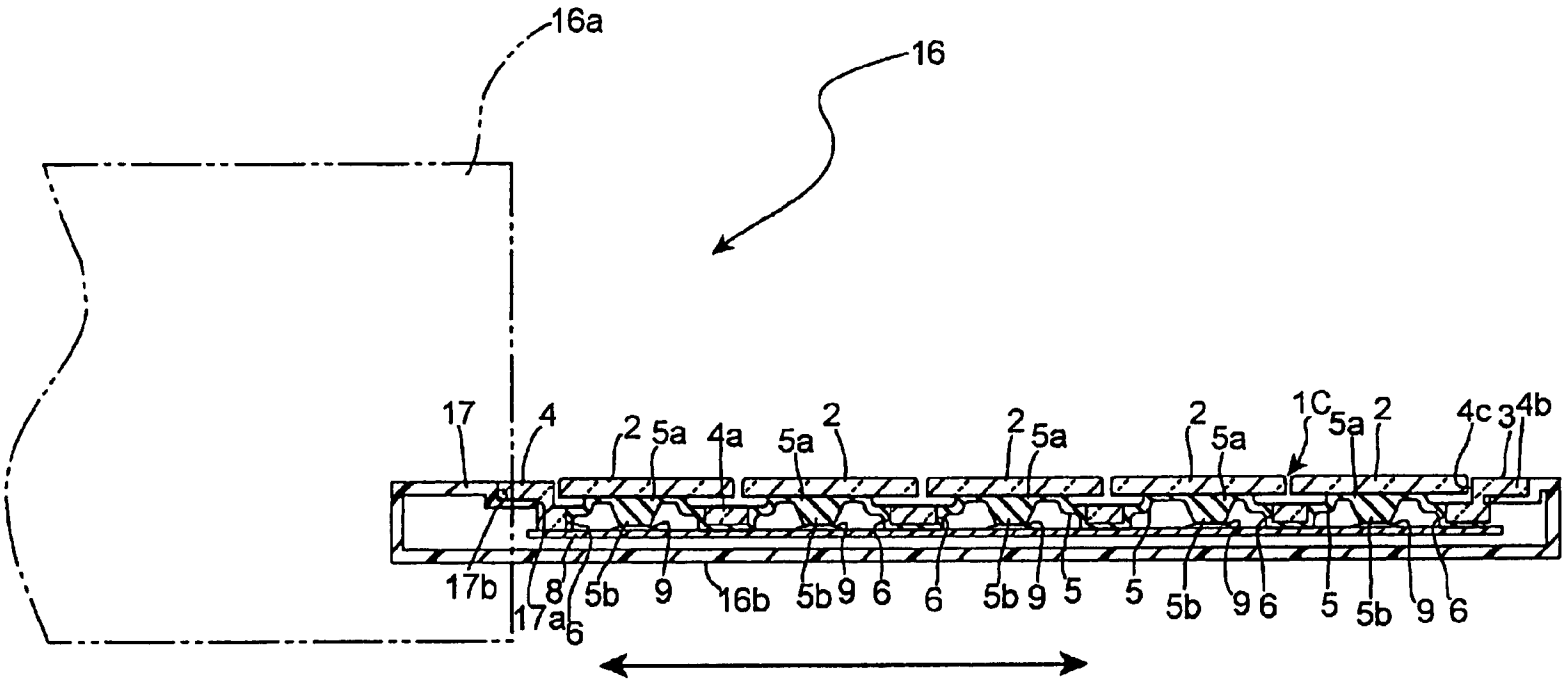

FIGS. 15 and 16 show a modified example 16 of the mobile equipment into which the key unit with support frame of the present invention is incorporated. A key unit 1C for use in the mobile equipment 16 basically has the configuration similar to the above-mentioned key unit 1, while the key shapes differ from each other. Accordingly, for the parts of the key unit 1C which have the configuration similar to the above-mentioned key unit 1, an explanation is omitted by using the same symbol as the one used in the above-mentioned key unit 1.

That is, in mobile equipment (a PDA is assumed in this case; hereinafter, referred to as "PDA"), a part 16*b* to which a key unit 1D is attached (hereinafter, referred to as "attached part") is freely housed into a main body 16*a* by sliding into the main body 16*a*. In the attached part 16*b*, as shown schematically in the sectional view of FIG. 16, the key unit 1C is attached and fixed to the attached part 16*b* by fitting the support frame 4*b* into an opening 17*a* and a step 17*b* provided on a casing 17, or by other means. Thus, the key unit with support frame of the present invention can also bring to the mobile equipment new possibility in the aspect of shape.

Embodiment 4

The key unit 21 with metal support frame of Embodiment 4 is in principle the same as the one made of a hard resin shown in Embodiment 1, except that the material for the key unit 21 with support frame is a metal.

The schematic structure of the key unit 21 of Embodiment 4 has key tops 22 which are formed in a desired shape and a keypad 23, as shown in FIGS. 17 to 26. The keypad 23 has a reinforcing plate 24 shaped like a plate with its central portion formed in a concave shape with respect to its circumferential portion, and a pad member 25 constituting a key operation part. The key top 22 and the reinforcing plate 24 are formed using a light metal material with or above a certain degree of rigidity such as magnesium, aluminum, stainless steel, titanium or the like except for a material prone to corrode, by means of an arbitrary molding/working method such as press working, forging, casting or the like. The pad member 25 is formed in such a manner as to have a film structure of translucent rubber elastic bodies such as a silicone rubber a thermoplastic elastomer or the like. The keypad 23 is formed, for example, by means of insert molding applied to a molded reinforcing plate 24 which has already been formed when the pad member 25 is molded.

The above-mentioned reinforcing plate 24 comprises a base 24*a* in which a multiplicity of apertures 26 in various shapes are formed and which constitutes the bottom portion of the central concave portion of the reinforcing plate 24, and a support frame 24*b* which extends in the circumferential direction so as to surround the perimeter of the base 24*a* and is provided at higher position than the base 24*a*. The base 24*a* and the support frame 24*b* are coupled in the longitudinal direction by a step 24*c*. Thus, as shown in section in FIGS. 21 and 22, it can be said that the reinforcing plate 24 has the approximate shape of a vessel in which the support frame 24*b* is protruded upward with respect to the base 24*a*.

Figure 18:
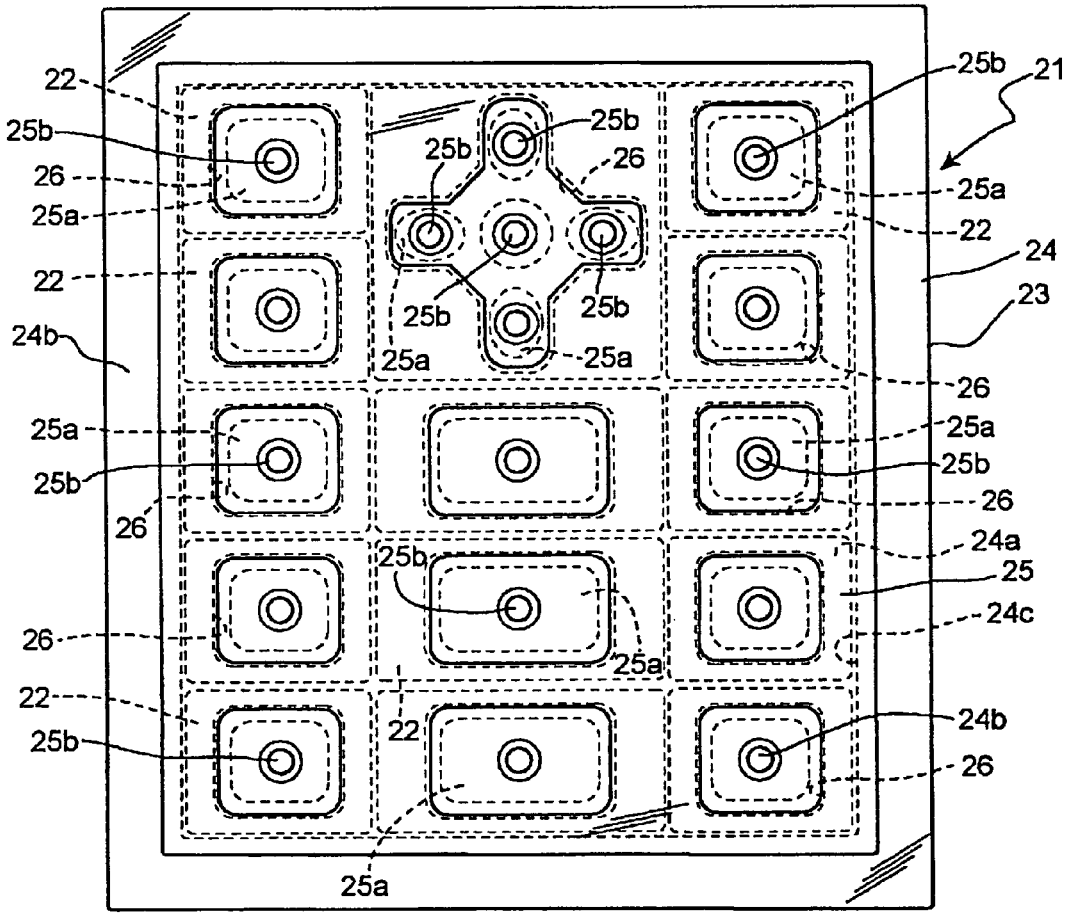
Figure 19:
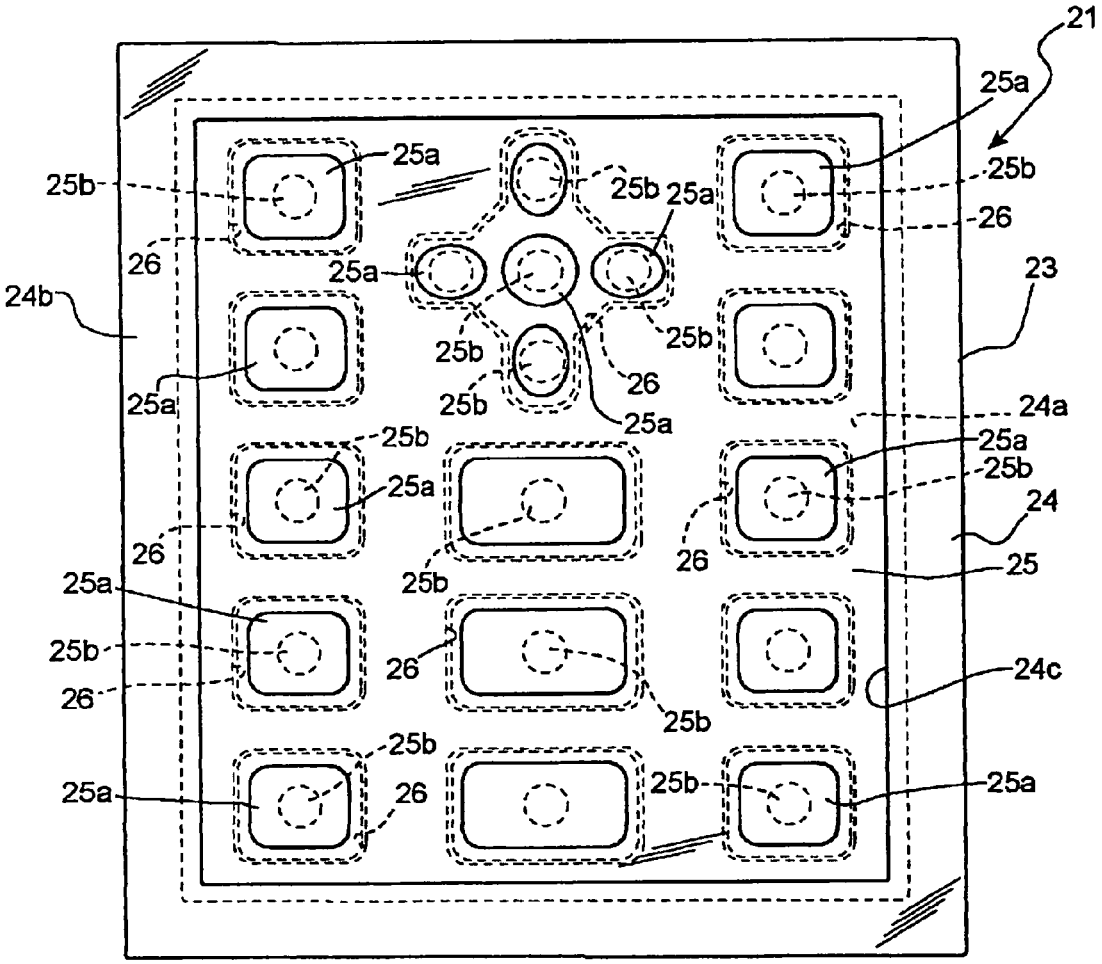
Figure 20:
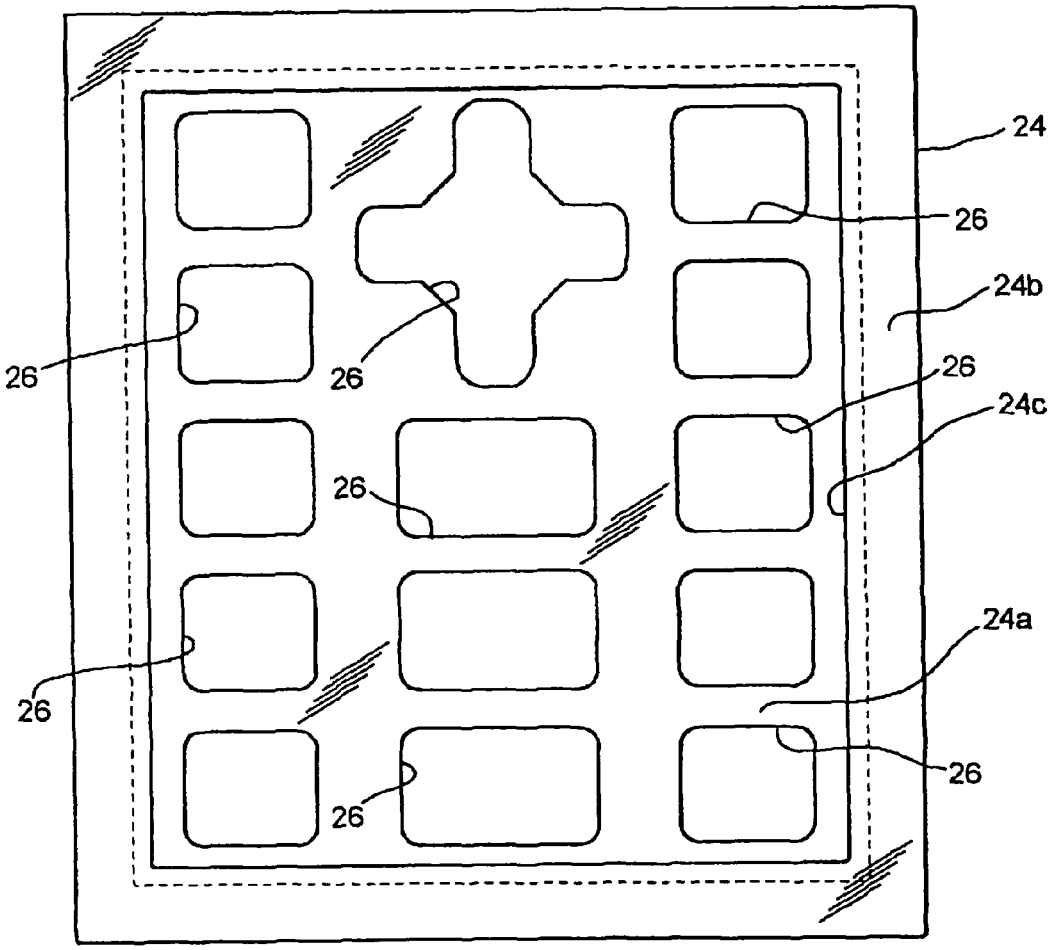
Figure 21:
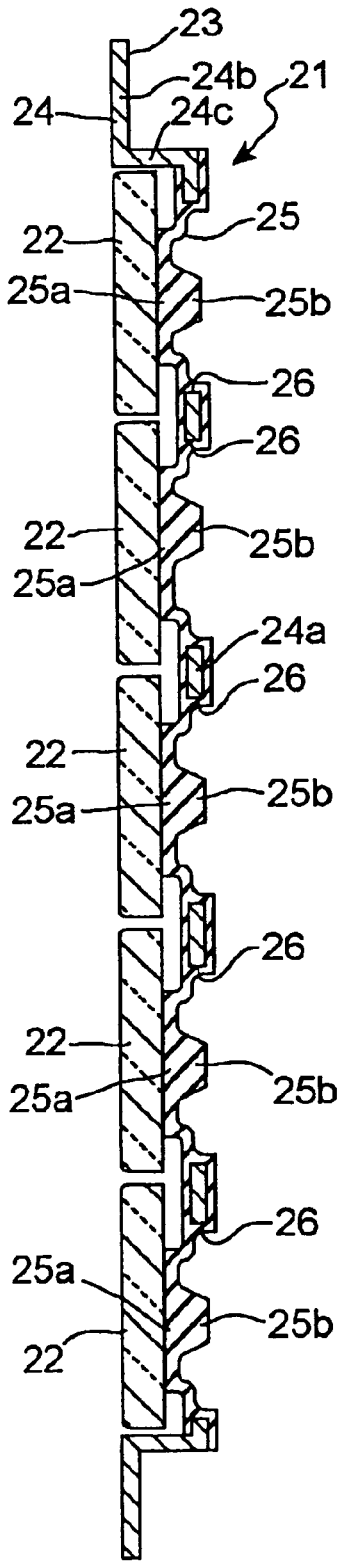
Figure 22:
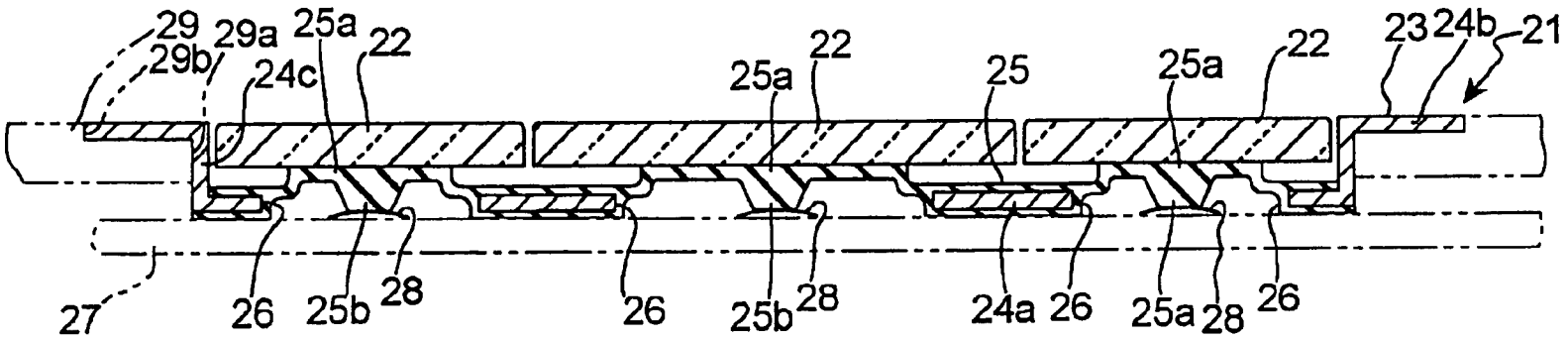

As shown in FIGS. 18 and 19, apertures 26 of the above-mentioned reinforcing plate 24 are sealed, respectively, by a pad member 25. Further, in the present embodiment, the pad member 25 is, by way of example, formed in such a shape as to cover the overall surface of each one of the top surface and the undersurface of the reinforcing plate 24, except for a part thereof, and sandwich the reinforcing plate 24 between the top surface and the undersurface. In FIGS. 21 and 22, there is shown the one which is integrally formed from a part covering each one of the top surface and the undersurface of the reinforcing plate 24 and a part covering each aperture 26, but the shape of the pad member 25 is not limited thereto. It may be possible to form the pad member 25 configured by integrating a part which only covers one of each surface of the top surface and the undersurface of the reinforcing plate 24 and a part which seals each aperture 26. In addition, it may also be possible to form the pad member 25 in which only each of aperture 26 is covered, but the top surface and the undersurface are not covered.

Figure 23:
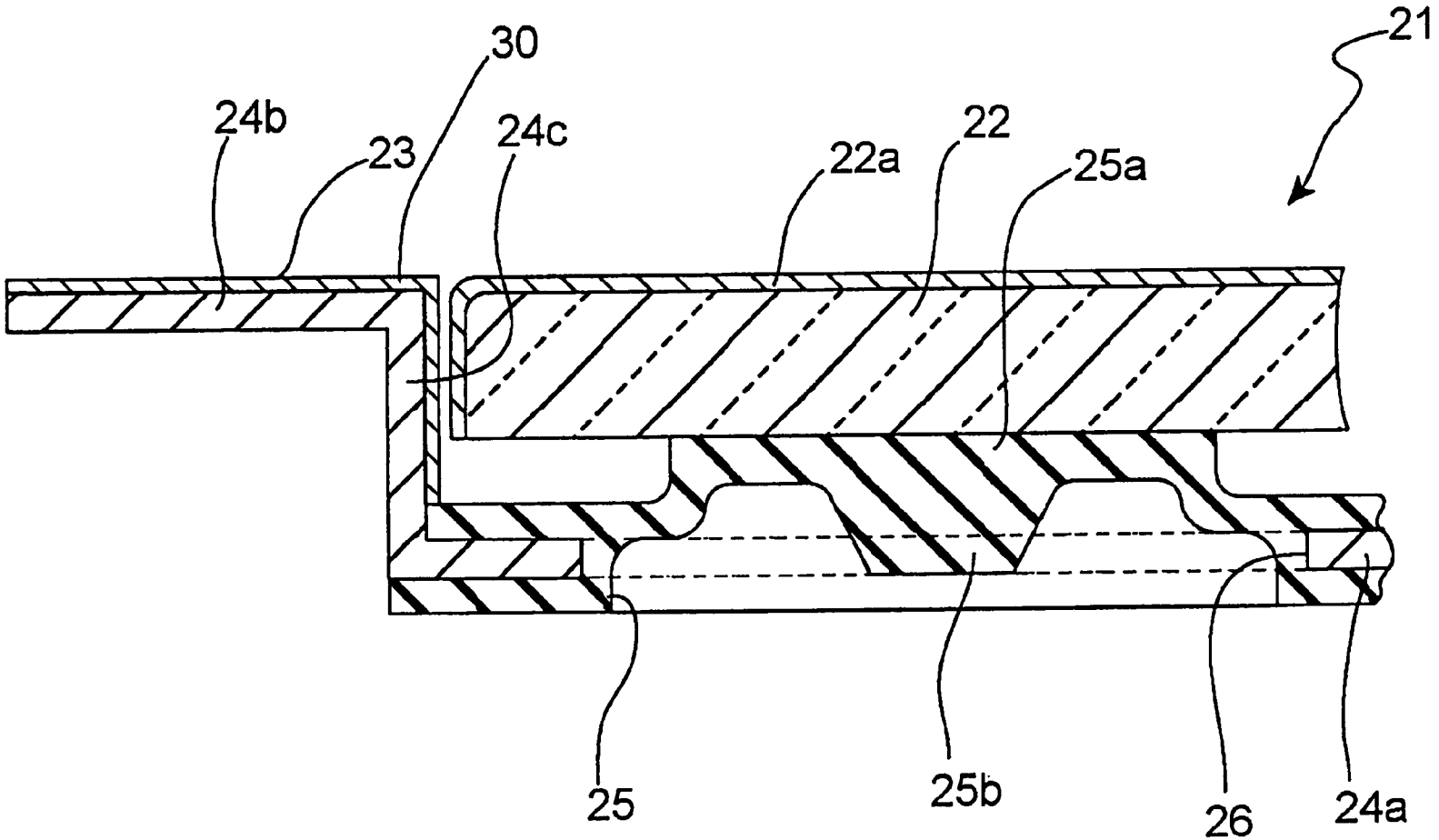

The end face of each pad member 25 is, as shown in FIGS. 22 to 23, fixed to the inner wall of an opening of each aperture 26 of the reinforcing plate 24; and forms the apex rising in a skirt-like manner from somewhat inner position of the opening edge of the aperture 26, with the apex constituting a key-fixing part 25*a* which the key top 22 is placed on and fixed to. The key tops 22 are adhered and fixed, respectively, to the top surface of each key-fixing part 25*a* using an adhesive or the like, and switch-pressing projections (pressing elements) 25*b* are formed integrally on a surface (undersurface) opposite to the above-mentioned key-fixing part 25*a*.

Further, in FIG. 22, a plate body 27 indicated by chain double-dashed line is a printed wiring board on which a multiplicity of switch elements (such as metal dome switches 28 and contacts not shown) or the like, are provided. In the present Embodiment 4, the above-mentioned key-fixing part 25*a* is configured to be projected toward one side (upward), but it is not necessarily required to have such structure. It is possible to form the part 25*a* in an appropriate shape by, for example, configuring it to be positioned at the same level as the surface of the reinforcing plate 24. In a word, it may be sufficient if the switch element 28 is ensured to operate by the pressing element 25*b* when pressing the key top 22. In addition, the shading sheet 7 of Embodiment 1 illustrated in FIGS. 6 to 9 becomes unnecessary since the metal reinforcing plate 24 itself has shading effect.

Decorations including letters, symbols or the like which represent the function of each corresponding key are applied to the top surface or the undersurface (the surface at the side which is fixed to the pad member 25) of the key tops 22 using the above-mentioned various decoration methods. Further, similar decoration is also applied to the top surface of the support frame 24*b* of the reinforcing plate 24.

Figure 24:
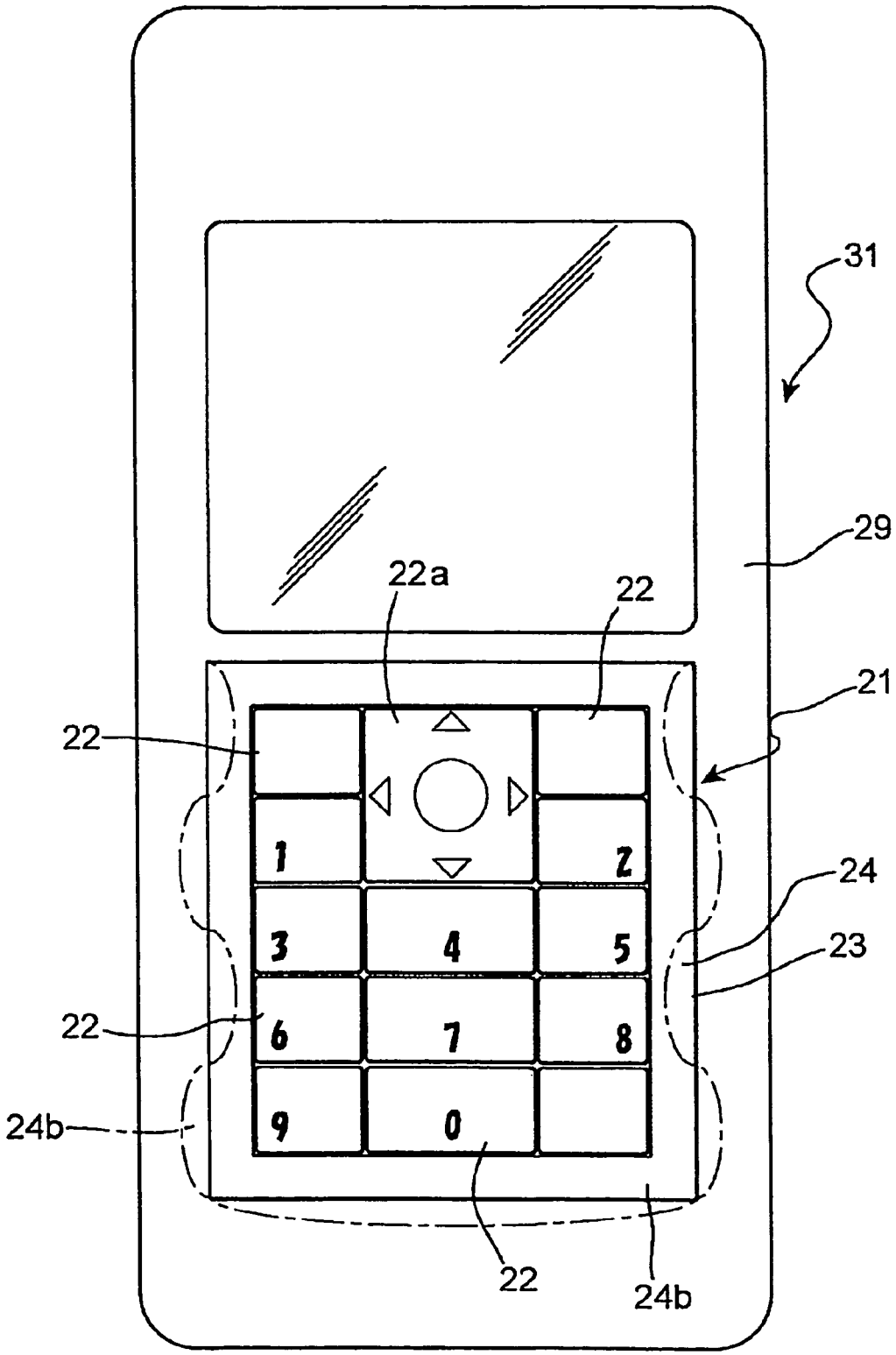

That is, as shown in FIG. 24, a decorative layer 30 is provided by arbitrary means on the top surface of a portion exposed to the outside of the circumferential portion such as the support frame 24*b* and the step 24*c* of the reinforcing plate 24. The decorative layer 30 is constituted generally by a plurality of layers peculiar to various decoration methods. The plurality of layers mean, for example, a character layer on which characters such as letters or symbols are formed in a positive manner or a negative manner, an overcoat layer which imparts abrasion resistance, a coloring layer which colors letters or symbols, a foundation layer, or the like, when a decoration is applied to the surface by means of printing or painting. It should be added that, in FIG. 24, 22*a* is an appropriate decorative layer provided on the surface of the key top. In addition, it should be understood that a decoration to the key top 22 is not limited to the surface. It is also arbitrary to provide the decoration on the surface (bottom surface or undersurface) fixed to the pad member 25 by means of an adhesive or the like.

The decorative layers 30 allow the key unit 21 to have decorative effect by coloring the support frame 24*b* of the reinforcing plate 24 which constitutes the circumferential portion of the key unit 21 or by forming patterns or pictures thereon, and to have a further designed feature in addition to the decorative effect of the key top 22. Furthermore, positive or negative arbitrary letters, symbols or the like may also be formed on the support frame 24*b* in the same manner as the key.

An example showing the key unit 21 in Embodiment 4 being incorporated into a portable phone 31 has substantially the same outer appearance as that of FIG. 10 showing Embodiment 1. That is, the key unit 21 in Embodiment 4 is, for example, fixed by fitting the support frame 24*b* of the reinforcing plate 24 into a receiving portion (an opening 29*a*, a step 29*b* or the like provided on a casing 29 shown in FIG. 22) provided on a casing 31 of the portable phone, as shown in FIG. 24. Further, the illustrated key unit 21 has an outline of approximately rectangular, but the outline shape of the key unit 21 is not limited to a specific one. In addition to decorative effect applied to the support frame 24*b*, it is also possible to allow to have a designed feature by forming the circumferential shape and the entire portion of the support frame 24*b* into various shapes, for example, by using a wave-like curve for the circumferential shape of the support frame of the reinforcing plate 24 as shown by an alternate short and long dash line in FIG. 10.

The portable phone 31 can achieve various and novel designs which differ from conventional ones by means of the decoration and shape of the support frame 24*b* of the reinforcing plate 24 which surrounds the perimeter of the key groups. Further, the key unit 21 also allows a method for use of detaching/replacing the key unit appropriately according to need or preference with preparing a plurality of key units with support frames which correspond to various uses or designs for the main body of a single portable phone 31, by forming on the casing 30 the support frame 24*b* and the receiving portion (opening or notch) capable of detaching it.

Embodiment 5

Figure 26:
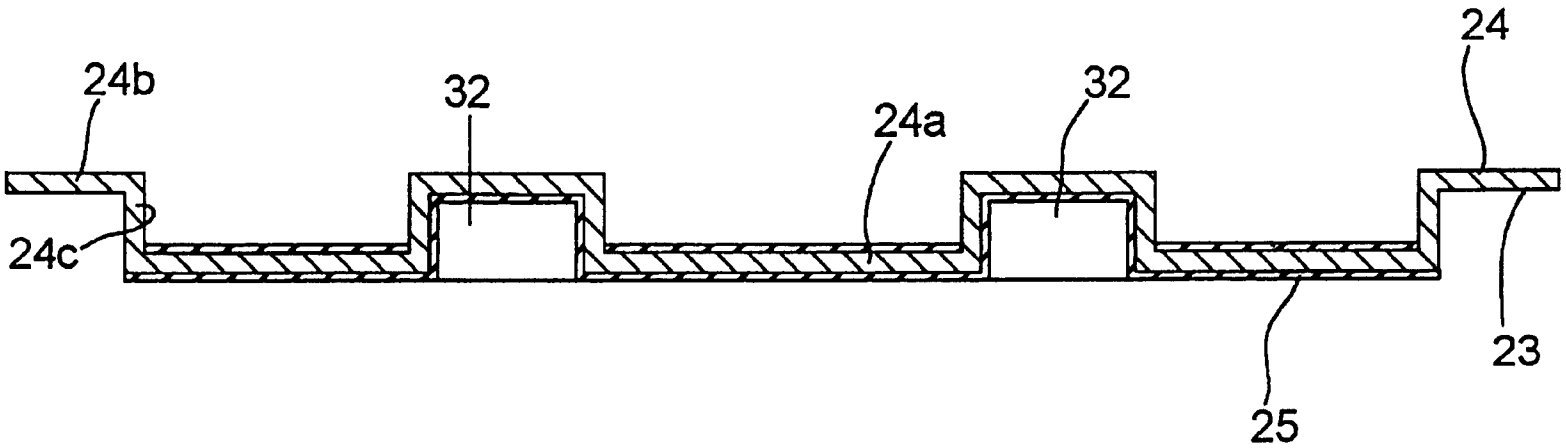

While the plan view showing Embodiment 5 of the key unit with support frame of the present invention can be seen similarly to FIG. 11 showing Embodiment 2, their sectional views slightly differ from each other. The plan view of Embodiment 5 is shown in FIG. 25, and the sectional view of the line h-h in FIG. 25 is shown in FIG. 26. Embodiment 5 has a structure in which a part of the reinforcing plate 24 is exposed to the outside as exposed parts 32 from the space between the keys. The only difference from the key unit 21 in the above-mentioned Embodiment 4 is whether the exposed parts 32 are present or not. Accordingly, for the parts which have the configuration similar to the above-mentioned Embodiment 4, an explanation is omitted by using numerical symbols used in the above-mentioned Embodiment showing reference numbers with adding FIG. 20 to the reference number used in the above-mentioned embodiments. The key unit 21A is an example in which five locations between the keys of the reinforcing plate 24 are exposed from the space between the key tops 22 as the exposed parts 32, so that each exposed part 32 is formed into an appropriate shape such as a star shape or a dumpling shape, or into an arbitrary letter string of "ABCDE."

Thus, in such key unit, providing the exposed part 32 capable of freely setting the number and the shape thereof allows to bring a more novel effect to the key unit and the equipment using it in the aspect of design, by means of various decorations and shapes applied to the exposed part 32 in addition to a decoration to the support frame 24*a*.

Embodiment 6

The outer appearance of the key unit 21B in Embodiment 6, which is another embodiment of the key unit with metal support frame of the present invention, is shown similarly in FIG. 27. The key unit in the present Embodiment 6 differs from the above-mentioned two Embodiments 4 and 5 only in a part of the shape of the reinforcing plate 24, and is a modified example of design in which the exposed part 32 is exposed from the space between all of each key tops 22, i.e., in the key unit 21A, the exposed parts 32, which are a plurality of divided sections, are molded integrally so as to surround the perimeter of all the key tops 22. Accordingly, for the parts of the key unit 21B which have the configuration similar to the above-mentioned key unit 21 and key unit 21A, an explanation is omitted by only showing reference numbers with adding FIG. 20 to the reference numbers used in Embodiments 1 to 3.

The reinforcing plate 24 of the key unit has a structure in which the apertures 26 in which the pad member 25 is arranged and other parts except one part of the perimeter of the opening edge of the aperture 26 are protruded to one side (upward) as the exposed part 32. The aperture 26 and a part 33 on which the key tops 22 of the reinforcing plate 24 constituted by a part of the perimeter of its opening edge is placed are relatively concave.

Thus, the key unit of the present invention, being different from the conventional one which has a key frame, can bring a novel effect to mobile equipment such as portable phones in the aspect of design, by means of various decorations and illuminations which are applied to the exposed part 32 of the reinforcing plate 24, which is equivalent to the key frame in addition to the support frame 24*b* of the reinforcing plate 24.

FIG. 29 shows a modified example 34 of the mobile equipment with the key unit into which the support frame of the present invention is incorporated. A key unit 21C for use in the mobile equipment 37 basically has the configuration similar to the above-mentioned key unit 21, while the key shapes differ from each other. Accordingly, for the parts of the key unit 21C which have the configuration similar to the above-mentioned key unit 21, an explanation is omitted by only showing reference numbers with adding FIG. 20 to the reference numbers used in Embodiments 1 to 3.

Figure 30:
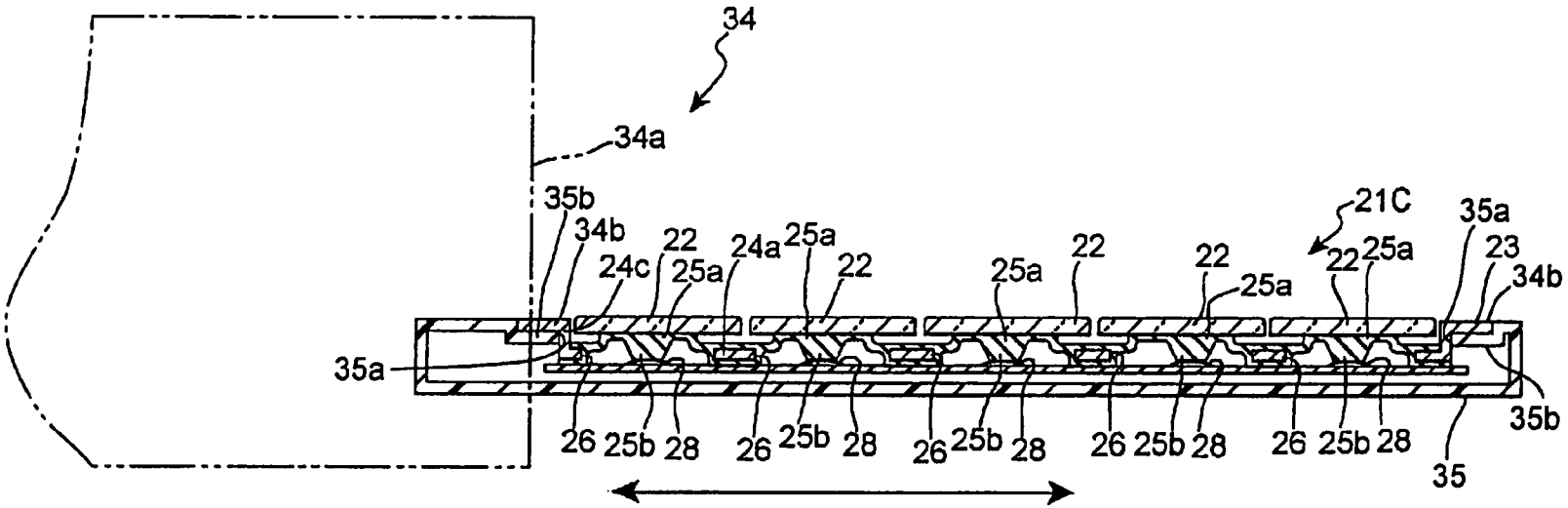

That is, in mobile equipment (PDA is assumed in this case; hereinafter, referred to as "PDA"), a part 34*b* to which a key unit 21C is attached (hereinafter, referred to as "attached part") is freely housed into a main body 34*a* by sliding into the main body 34*a*. In the attached part 34*b*, as shown schematically in the sectional view of FIG. 30, the key unit 21C is attached and fixed to the attached part 34*b* by fitting the support frame 34*b* into an opening 35*a* and a step 35*b* provided on a casing 35, or by other means. Thus, the key unit with support frame of the present invention can also bring to the mobile equipment new possibility in the aspect of shape.

INDUSTRIAL APPLICABILITY

Since the present invention relates to a key unit for use in mobile equipment such as portable phones, and personal digital assistants (PDA), it can be applicable to wider industrial fields such as information communication industries which utilize these equipment, including manufacturing industries of electronic equipment and other various components.

The invention claimed is:

1. A key unit that is installable in a mobile device comprising a casing having an opening, the key unit comprising:

(i) a key pad including pad members made of a rubber elastic body, and a reinforcing plate made of at least one of a hard resin and a metal, wherein the reinforcing plate comprises:

a base in which a plurality of apertures are formed and which constitutes a bottom portion of a central concave portion of the reinforcing plate;

a support frame which extends in a circumferential direction so as to surround a perimeter of the base, which is exposed to an outside of the mobile device, and which is positioned at a higher level than the base in a vertical direction, wherein the support frame is adapted to be fitted into the opening of the casing of the mobile device so as to install the key unit directly from outside of the mobile device; and a step by which the base and the support frame are coupled in the vertical direction;

(ii) a decorative layer which covers a surface of the support frame of the reinforcing plate and to which a decoration is one of applied, molded, and formed into a shape of a letter or symbol; and (iii) a shading sheet which covers at least connection parts of the base and the pad members.

2. The key unit according to claim 1, wherein the reinforcing plate further comprises exposed parts which are exposed to the outside of the mobile device from a space between keys and to which a decoration is one of applied, molded, and formed into a shape of a letter or symbol.

3. The key unit according to claim 1, wherein the reinforcing plate is formed using a resin selected from a group of transparent hard resins consisting of PC (polycarbonate resin), PET (polyethylene terephthalate resin), PMMA (polymethylmethacrylate/acrylate resin), and a mixture thereof.

4. The key unit according to claim 1, wherein the reinforcing plate including the support frame is made of metal or an alloy composed of one or more of magnesium, aluminum, stainless steel, titanium, copper, and gold.

5. The key unit according to claim 1, wherein the decoration is applied using a method selected from a group consisting of printing, painting, and a film-forming method with a metal or a nonmetal.

6. The key unit according to claim 2, wherein the decoration is applied to at least one of the exposed parts of the reinforcing plate using a method selected from a group consisting of printing, painting, and a film-forming method with a metal or a nonmetal.

* * * * *